US007331573B2

(12) United States Patent
Mizuta et al.

(10) Patent No.: US 7,331,573 B2
(45) Date of Patent: Feb. 19, 2008

(54) SHEET TREATING APPARATUS AND IMAGE FORMING APPARATUS

(75) Inventors: Yoshimi Mizuta, Chiba (JP); Toshimasa Suzuki, Chiba (JP); Masaaki Inoo, Tokushima (JP); Daisaku Kamiya, Chiba (JP); Hiromichi Tsujino, Ibaraki (JP); Junichi Moteki, Chiba (JP); Shunsuke Nishimura, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/352,241

(22) Filed: Feb. 13, 2006

(65) Prior Publication Data

US 2006/0125171 A1 Jun. 15, 2006

Related U.S. Application Data

(62) Division of application No. 10/233,589, filed on Sep. 4, 2002, now Pat. No. 7,021,616.

(30) Foreign Application Priority Data

Sep. 7, 2001 (JP) ..... 2001-272175
Sep. 7, 2001 (JP) ..... 2001-272178
Aug. 21, 2002 (JP) ..... 2002-240238

(51) Int. Cl.
*B65H 37/04* (2006.01)

(52) U.S. Cl. ..... 270/58.14; 270/58.08; 270/58.11; 270/58.12; 270/58.13; 270/58.15; 270/58.16; 270/58.17; 399/403; 399/410; 271/292; 271/294; 271/299

(58) Field of Classification Search ..... 270/58.08, 270/58.11, 58.12, 58.13, 58.14, 58.15, 58.16, 270/58.17; 399/403, 410; 271/292, 294, 271/299

See application file for complete search history.

(56) References Cited

U.S. PATENT DOCUMENTS 4,134,581 A 1/1979 Johnson et al. ..... 271/173

(Continued)

FOREIGN PATENT DOCUMENTS

EP 1 067 440 A2 1/2001

(Continued)

OTHER PUBLICATIONS

Patent Abstracts of Japan, Publication No. 5-58537, Mar. 9, 1993.
Patent Abstracts of Japan, Publication No. 11-180597, Jul. 6, 1999.

*Primary Examiner*—Gene O. Crawford
*Assistant Examiner*—Leslie A Nicholson, III
(74) *Attorney, Agent, or Firm*—Fitzpatrick, Cella, Harper & Scinto

(57) ABSTRACT

A sheet treating apparatus for treating a sheet having an image formed thereon is provided, which includes a pair of transport rollers for transporting the sheet upward, a sheet post-treating portion having an intermediate treatment tray, provided to execute post-treatment such as sheet stitching or punching while holding the sheet in a substantially vertical state, and a sheet delivery portion arranged above the sheet post-treating portion. Also, an image forming apparatus is provided, which includes an image reading portion for reading an image, an image forming portion arranged below the image reading portion to form an image on a sheet, a delivery space portion provided in an apparatus housing between the image reading portion and the image forming portion to deliver the sheet, sheet treating portion for treating the sheet while holding it in a substantially vertical state, and an in-body transportation path for transporting the sheet treated by the sheet treating means to the delivery space portion.

4 Claims, 20 Drawing Sheets

U.S. PATENT DOCUMENTS

| | | | | |
|---|---|---|---|---|
| 4,141,546 | A | 2/1979 | Queener | 271/173 |
| 4,170,349 | A | 10/1979 | Baumann et al. | 271/296 |
| 5,137,265 | A | 8/1992 | Sato et al. | 270/53 |
| 5,382,011 | A * | 1/1995 | Tani | 270/37 |
| 5,398,918 | A | 3/1995 | Rizzolo et al. | 270/53 |
| 5,473,420 | A | 12/1995 | Rizzolo et al. | 355/321 |
| 5,640,232 | A | 6/1997 | Miyake et al. | 399/18 |
| 5,765,824 | A | 6/1998 | Kawano et al. | 270/58.11 |
| 5,778,300 | A | 7/1998 | Murakami et al. | 399/403 |
| 5,938,186 | A | 8/1999 | Sato et al. | 270/58.11 |
| 5,951,000 | A | 9/1999 | Sato et al. | 270/58.11 |
| 6,002,849 | A | 12/1999 | Koh et al. | 395/117 |
| 6,206,365 | B1 | 3/2001 | Nanba et al. | 271/217 |
| 6,231,045 | B1 * | 5/2001 | Yamada et al. | 271/292 |
| 6,305,681 | B1 | 10/2001 | Watanabe et al. | 270/58.08 |
| 6,371,471 | B1 | 4/2002 | Fukazu et al. | 270/58.09 |
| 6,406,013 | B1 | 6/2002 | Nanba et al. | 270/58.11 |
| 6,527,269 | B2 | 3/2003 | Yamada et al. | 271/221 |
| 7,104,538 | B1 * | 9/2006 | Kimura et al. | 271/291 |

FOREIGN PATENT DOCUMENTS

| | | |
|---|---|---|
| JP | 63-235261 | 9/1988 |
| JP | 5-58537 | 3/1993 |
| JP | 7-48062 | 2/1995 |
| JP | 11-180597 | 7/1999 |
| JP | 11-199128 | 7/1999 |
| JP | 2000-44106 | 2/2000 |

* cited by examiner

SHEET TREATING APPARATUS AND IMAGE FORMING APPARATUS

CROSS-REFERENCE TO RELATED APPLICATION

This application is a divisional of application Ser. No. 10/233,589, filed Sep. 4, 2002 now U.S. Pat. No. 7,021,616.

BACKGROUND OF THE INVENTION

1. Field of the Invention

The present invention relates to a sheet treating apparatus and an image forming apparatus, which can reduce installation space. The invention also relates to an image forming apparatus, which includes an image reading portion for reading an image, an image forming portion for forming an image on a sheet, and a sheet delivering space provided inside the apparatus. More particularly, the invention is directed to a sheet treating apparatus and an image forming apparatus, which can save space for the apparatus without losing visual recognizability or taking-out operability of a delivered sheet, and without making the apparatus complex.

2. Related Background Art

A conventional image forming apparatus including an original image reading portion such as a copying machine or a facsimile machine has generally been constructed in such a manner that the image reading portion is arranged in the upper portion of the apparatus, an image forming portion is provided in its lower portion, and recording sheets having images formed by the image forming portion are delivered from a side face of the apparatus to the outside, and stacked.

In recent years, however, in order to save space, as shown in FIG. 19, an apparatus has been made available, which includes space 103 provided between an image reading portion 101 and an image forming portion 102, and recording sheets are delivered and stacked in this space 103.

At the image reading portion 101, image information is fetched into a photoelectric transfer element by exposing and scanning an original sent from an auto original feeder (ADF) arranged thereon, and data processing is carried out.

Then, based on the data, a laser scanner 104 scans a photosensitive drum 105 to form a latent image. A toner image developed on the photosensitive drum 105 according to the latent image is transferred onto a sheet fed from a feed cassette 106, passed through a fixing device 107 to be fixed on the sheet, and delivered and stacked in the delivery space 103 by a delivery roller 108.

In the above-described image forming apparatus, to execute post-treatment such as punching or stapling on the sheet having an image recorded, as shown in FIG. 20, a sheet treating apparatus 110 is connected to a side part of an apparatus main body. The sheet is fed into this sheet treating apparatus 110, and subjected to stapling or the like.

However, the connection of the sheet treating apparatus 110 to the side part of the apparatus requires wide installation space. A reduction in this space only leads to a complex structure of the apparatus, deteriorating sheet taking-out operability.

SUMMARY OF THE INVENTION

The present invention was made with the foregoing in mind, and an object of the invention is to provide a sheet treating apparatus and an image forming apparatus, which can save space for the apparatus without losing visual recognizability or taking-out operability of a delivered sheet.

In order to achieve the foregoing object, according to a representative constitution of the present invention, a sheet treating apparatus is provided for treating a sheet having an image formed thereon. This sheet treating apparatus includes transporting means for transporting the sheet upward, a sheet post-treating portion for executing post-treatment such as sheet stitching or punching by holding the sheet in a substantially vertical state, and a sheet delivering portion arranged above the sheet post-treating portion.

Also, the invention provides an image forming apparatus, which includes an image reading portion for reading an image, an image forming portion arranged below the image reading portion to form an image on a sheet, a delivery space portion provided in an apparatus housing between the image reading portion and the image forming portion to deliver the sheet, sheet treating means for executing treatment by holding the sheet in a substantially vertical state, and an in-body transportation path for transporting the sheet treated by the sheet treating means to the delivery space portion.

As described above, since treatment such as stapling can be carried out while the sheet is held in the substantially vertical state, it is possible to reduce apparatus installation space without damaging productivity.

Moreover, according to the invention, since sheet treatment is carried out while the sheet is held in the substantially vertical state, and then the sheet can be delivered to the delivery space portion provided in the apparatus housing, it is possible to reduce apparatus installation space.

BRIEF DESCRIPTION OF THE DRAWINGS

FIG. 17A is a sectional view of the sheet treating means; and FIG. 17B is an explanatory view of the sheet treating means as seen along a direction indicated by the arrow A of FIG. 17A.

FIG. 18A is a view showing a state of supporting a sheet lower end; and FIG. 18B is an explanatory view showing a state of freeing a sheet-stack to an in-body transportation path.

DETAILED DESCRIPTION OF THE PREFERRED EMBODIMENTS

Next, description will be made of an image forming apparatus provided with a sheet treating apparatus according to an embodiment of the present invention with reference to the accompanying drawings.

First Embodiment

Figure 1:
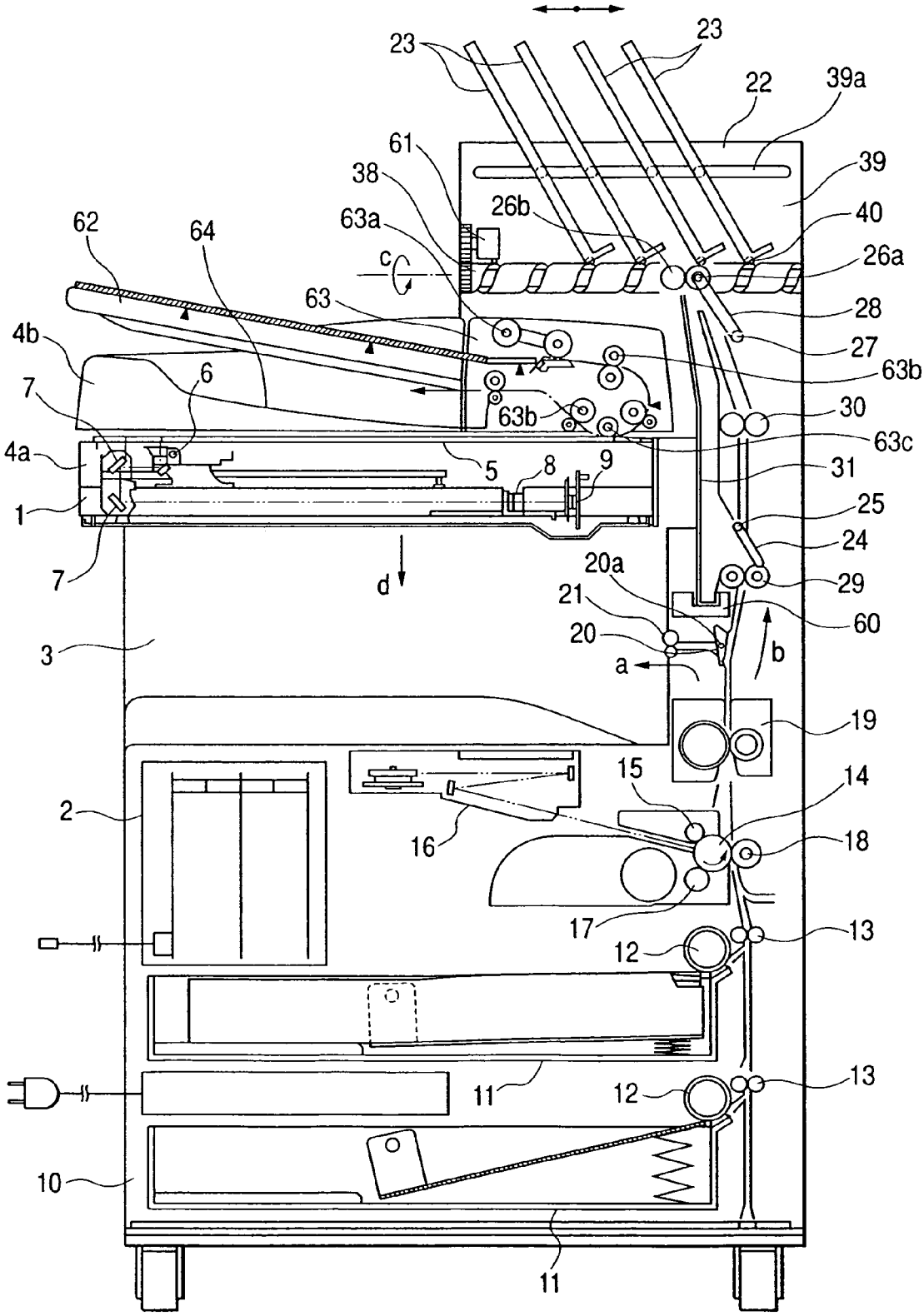
FIG. 1 is a sectional explanatory view showing an entire imager forming apparatus according to a first embodiment.

FIG. 1 is a sectional explanatory view showing an image forming apparatus according to a first embodiment.

{Entire Constitution of Image Forming Apparatus}

This image forming apparatus comprises an image reading portion 1 as image reading means, and an image forming portion 2 as image forming means. The image reading portion 1 is arranged above the image forming portion 2. A delivery space portion 3 is formed in an apparatus housing between these two portions. A sheet, on which recording is made by the image forming portion 2, is delivered onto the delivery space portion 3. Accordingly, the image forming apparatus is made a so-called in-body delivery type. Also, a sheet treating apparatus is provided above the image forming portion 2 to execute treatment such as punching or stapling on the sheet having an image formed thereon.

(Image Reading Portion)

The image reading portion 1 of the embodiment includes an ADF 4*b* attached on a scanning optical system 4*a* for optically reading an original, and reads an original fed onto a platen glass plate 5 from the ADF 4*b* or an original directly set on the platen glass plate 5 by rotating and opening the ADF 4*b* based on exposure scanning carried out by the scanning optical system 4*a*. That is, the image reading portion 1 irradiates the original on the platen glass plate 5 with a light while scanning a light source 6, condenses its reflected light on a photoelectric transfer element 9 through a mirror 7 and a lens 8, then converts it into an electrical digital signal and transmits it. The apparatus functions as a copying machine when this digital signal is sent to its own image forming portion 2, and functions as a facsimile machine when it is sent to an image forming portion of the other apparatus.

It is not always necessary for the image-reading portion 1 to include the ADF 4*b*. In other words, it may include an original pressing member for pressing the original set on the platen glass plate 5 of the scanning optical system 4*a*.

(Image Forming Portion)

The image forming portion 2 forms, by electrophotography, a toner image on a sheet transported from a sheet cassette 11 loaded on a sheet feeding portion 10 provided below the image forming portion 2 by a feed roller 12 and a transport roller 13. That is, a surface of a photosensitive drum 14 rotated in a direction indicated by the arrow of FIG. 1 is uniformly charged by a charge roller 15. Then, on this photosensitive drum 14, selective exposure is carried out by a laser scanner 16 for light irradiation based on image information sent from the image reading portion 1, a personal computer or the like to form a latent image. The latent image is toner-developed by a developing device 17 to be made visible. The toner image is then transferred to a sheet transported by bias application to a transfer roller 18.

The sheet having the toner image thus transferred is directly transported to a fixing device 19 located above, where heat and pressure are applied to fix toner. Then, the sheet is delivered to a predetermined delivery portion.

That is, the sheet passed through the fixing device 19 is transported selectively in a direction indicated by the arrow "a" or "b" by rotation of a first changeover flapper 20 around a fulcrum 20*a* (FIG. 1 shows a state where the direction indicated by the arrow "b" is selected.).

Selection of the transporting direction indicated by the arrow "a" or "b" is decided by selection of a delivery portion made beforehand by an operator. Selection of the delivery portion can be carried out by an operation portion of the apparatus, a personal computer or the like for each job. However, a delivery portion may be preset depending on a type or a content of a job.

For example, in the case of an output from a not frequently used facsimile machine, the sheet is delivered from the delivery roller 21 to the delivery space portion 3, and a transporting direction is set in the direction indicated by the arrow "a". On the other hand, in the case of a copy or a printer job needing assortment, a plurality of delivery trays 23 provided in the delivery portion 22 are selected, and a transporting direction is set in the direction indicated by the arrow "b".

In the case of a copy needing no assortment even in a copy job, the delivery space portion 3 can be set as a delivery destination in order to shorten output time.

(Upper Delivery Portion)

As shown in FIG. 1, a plurality of delivery trays 23 provided above the image reading portion 1 of the embodiment are arranged in a transverse direction (a direction of intersecting a sheet delivering direction and a horizontal direction in the embodiment) in a state of being obliquely upright. Each of the delivery trays 23 is moved left and right by a spiral groove lead cam 38 rotated in a direction indicated by the arrow "c" by a driving source 61, and a guide rail 39*a* provided in a rear plate 39 for supporting a rear side of the delivery tray 23.

That is, a runner 40 is provided in each of lower ends of both front and rear ends of each delivery tray 23 to be engaged with the groove of the lead cam 38, and the delivery tray 23 can be moved in the transverse direction from left to right by rotation of the lead cam 38. Then, a tray position is detected by a position detecting sensor (not shown), and stopped in a predetermined position. Thus, the sheet delivered by the pair of delivery rollers 26*a* and 26*b* is delivered to a predetermined delivery tray 23.

In the above-described delivery, on a sort mode, the delivery trays 23 are sequentially moved in association with the sheet delivery, and thus sheets are delivered to the plurality of delivery trays 23 in a sorted state. On the other hand, on a non-sort mode, the rightmost delivery tray 23 shown in FIG. 1 is moved to a position for receiving the sheet, and the sheet is delivered to that tray.

Since the plurality of delivery trays are arranged in the transverse direction as described above, the delivered sheets can be easily taken out. As the delivered sheet is supported by the delivery tray 23, the delivered sheet becomes obliquely upright. Thus, no delivery space is needed in the transverse direction even if a sheet size is large.

{Sheet Treating Apparatus}

Figure 2:
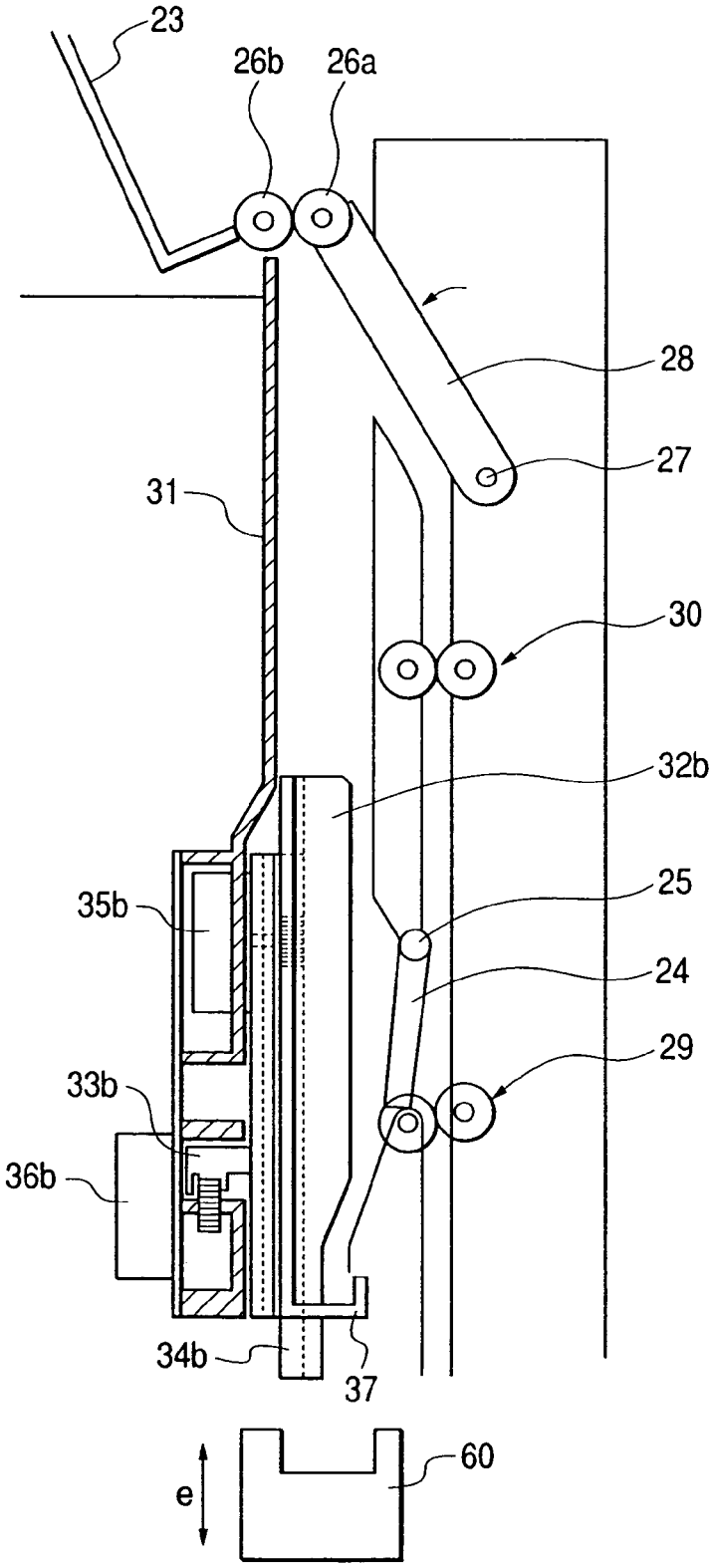
FIG. 2 is a sectional explanatory view showing a sheet post-treating portion when no sheet post-treatment is carried out.
Figure 3:
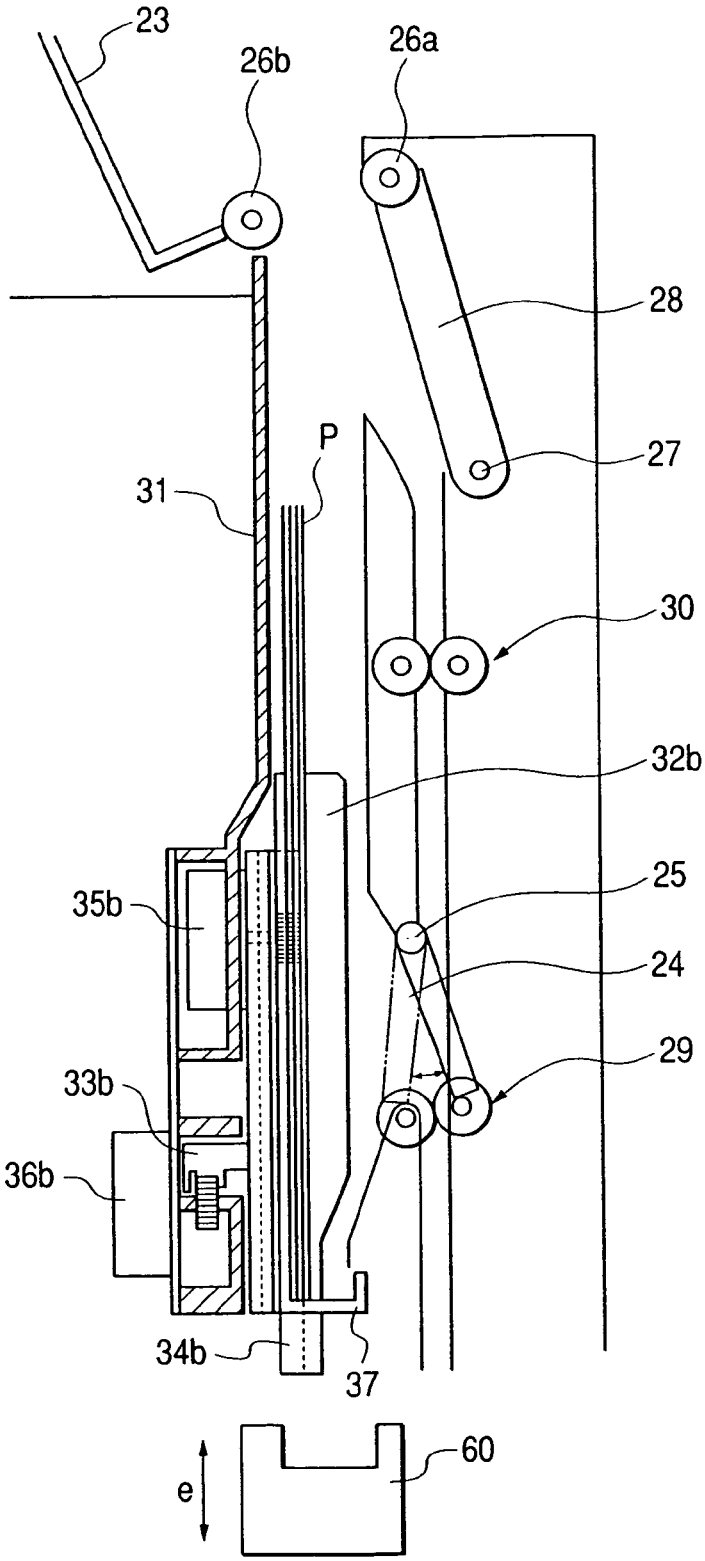
FIG. 3 is a sectional explanatory view showing a sheet post-treating portion when sheet post-treatment is carried out.

Next, description will be made of a constitution of the sheet treating apparatus for executing treatment such as punching or stapling in the embodiment with reference to FIGS. 2 to 6. The sheet treating apparatus of the embodiment transports sheets having images formed thereon into an intermediate treatment tray 31 having a substantially vertical stacking surface, aligns the sheets to form a sheet-stack, and delivers the sheet-stack upward to the delivery portion after stapling. FIG. 2 is a sectional explanatory view of a sheet post-treating portion when no sheet post-treatment is carried out; and FIG. 3 is a sectional explanatory view of the sheet post-treating portion when intermediate treatment is carried out.

(Transporting Means)

The sheet transported by the first changeover flapper in the direction indicated by the arrow "b" of FIG. 1 is then changed over for a transporting direction by a second changeover flapper 24 depending on the presence or absence of post-treatment.

That is, in the case of a job needing no sheet treatment such as stitching or punching, the second changeover flapper 24 is rotated around a fulcrum 25 to a position shown in FIG. 2. At this time, a sheet-stack delivery roller 26*a* is supported by a swing guide 28 swung around a fulcrum 27, and rotated to a position shown in FIG. 2.

The sheet is transported by first and second transport roller pairs 29 and 30 as transporting means to the sheet-stack delivery rollers 26*a* and 26*b* located above substantially vertically, and delivered and stacked on the delivery tray 23 located substantially vertically above the image forming portion 2.

Then, in the case of a job needing treatment, the second changeover flapper 24 is rotated around the fulcrum 25 to a position indicated by the solid line of FIG. 3, and a sheet P is transported into the intermediate treatment tray 31. At this time, the swing guide 28 supporting the sheet-stack delivery roller 26*a* is rotated around the fulcrum 27 to be separated from the sheet-stack delivery roller 26*b*, and retreated to a position shown in FIG. 3 during sheet transportation into the intermediate treatment tray 31 and during post-treatment.

By the retreating of the sheet-stack delivery roller 26*a*, an aligning operation at the intermediate treatment tray 31, and a post-treating operation at the same even for a sheet of a large size, in which a sheet leading edge is larger than the sheet-stack delivery roller 26*b*, can be carried out.

Then, when a trailing edge of the sheet P is out of the first transport roller pair 29, the second changeover flapper 24 is changed over to a position indicated by the double-dotted line of FIG. 3, and thus the trailing edge of the sheet P is guided toward the intermediate treatment tray 31. At this time, the first transport roller pair 29 is set to a rotational speed enough to kick out the trailing edge of the sheet P.

(Sheet Post-Treating Portion)

Figure 4:
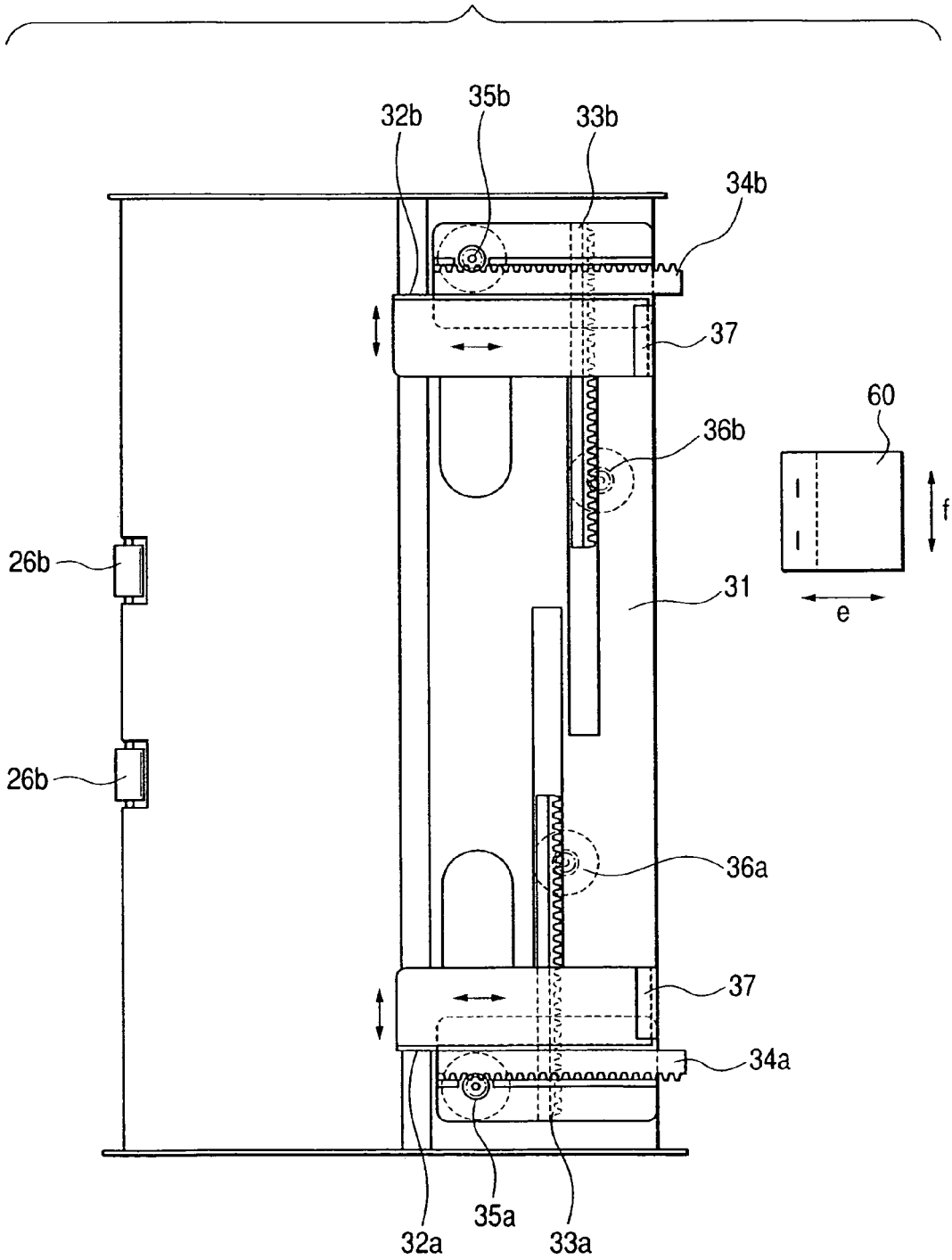
FIG. 4 is an explanatory view of aligning means.

The sheets P transported into the intermediate treatment tray 31 are held in a substantially vertical state and aligned as shown in FIG. 3 are subjected to stapling (sheet stitching treatment) by a staple unit 60 provided in a lower end so as to be moved in directions indicated by the arrows "e" and "f". Accordingly, in the intermediate treatment tray 31, as shown in FIG. 4, aligning means is provided to align sheet widths in a front/rear direction of the apparatus for each sheet stacking. FIG. 4 is an explanatory view of the aligning means showing a sheet cross direction (a direction orthogonal to a sheet transporting direction) up and down.

As shown in FIG. 4, the aligning means includes a front aligning plate 32*a* and a rear aligning plate 32*b* for aligning the front and rear sides (front and rear sides in FIG. 1) of the sheet cross direction. The front and rear aligning plates 32*a* and 32*b* are respectively provided to be reciprocated in upper and lower directions of FIG. 4 integrally with width aligning racks 33*a* and 33*b*, and reciprocated in left and right directions of FIG. 4 by sheet-stack delivery racks 34*a* and 34*b* respectively provided integrally in the front and rear aligning plates 32*a* and 32*b*, and sheet-stack delivery motors 35*a* and 35*b* provided in the width aligning plates 33*a* and 33*b*.

The width aligning racks 33*a* and 33*b* are attached to the intermediate treatment tray 31 so as to be reciprocated in the sheet cross direction by the width aligning motors 36*a* and 36*b*.

In each of lower ends (right end in FIG. 4) of the front and rear aligning plates 32*a* and 32*b*, a hit reference wall 37 is provided to be used as a reference in post-treatment. Needless to say, a part of the hit reference wall 37 may be fixed to the intermediate treatment tray.

The staple unit 60 is provided to execute stapling for the sheet stack transported into the intermediate treatment tray 31, and aligned in the sheet cross direction by the aligning means. This stable unit 60 is moved in the directions indicated by the arrows "f" and "e" in FIG. 4 to operate by driving means (not shown) during stapling. This unit is movable in a manner of not blocking a transportation path of the sheet stack.

The sheets P transported into the intermediate treatment tray 31 are hit against the hit reference wall 37 located in the lower end of the intermediate treatment tray with the aid of gravity. In the embodiment, since the hit reference wall 37 is provided in the lower end of each of the front and rear aligning plates 32*a* and 32*b*, when the sheet is transported into the intermediate treatment tray 31, a space between the front and rear aligning plates 32*a* and 32*b* is set larger than a width of the sheet to be transported in, and such that the plates 32*a* and 32*b* wait in standby positions for supporting the lower end of the sheet dropped to the intermediate treatment tray 31 with the aid of gravity by the front and rear hit reference walls 37.

As shown in FIG. 3, an end of the hit reference wall 37 is formed upright to prevent the deviation and falling-off of the hit sheet P, and U-shaped in section.

When the sheet lower end is dropped in the intermediate treatment tray 31 to hit against the hit reference wall 37, the width aligning motors 36*a* and 36*b* are driven. These driving forces are transmitted to the width aligning racks 33*a* and 33*b* to move the front and rear aligning plates 32*a* and 32*b*, and then aligning is carried out in the sheet cross direction. After the end of the alignment, the front and rear aligning plates 32*a* and 32*b* return to the standby positions. The sheets thus delivered sequentially are aligned one by one as described above, and a predetermined number thereof are stacked on the intermediate treatment tray 31 to form a sheet stack.

For the aligned sheet stack, for example if stapling is instructed through the operation portion, staples are driven into the sheet stack by the staple unit 60, and stapling is carried out. After the end of this post-treatment such as stapling, as shown in FIGS. 5 and 6, the front and rear aligning plates 32*a* and 32*b* are pushed up by the sheet-stack delivery racks 34*a* and 34*b* and driving of the sheet-stack delivery motors 35*a* and 35*b*, and a sheet stack P' having been subjected to post-treatment is transported by the reference walls 37 integrally formed with the aligning plates 32*a* and 32*b* at least until its leading edge reaches the pair of sheet-stack delivery rollers 26*a* and 26*b*.

Figure 5:
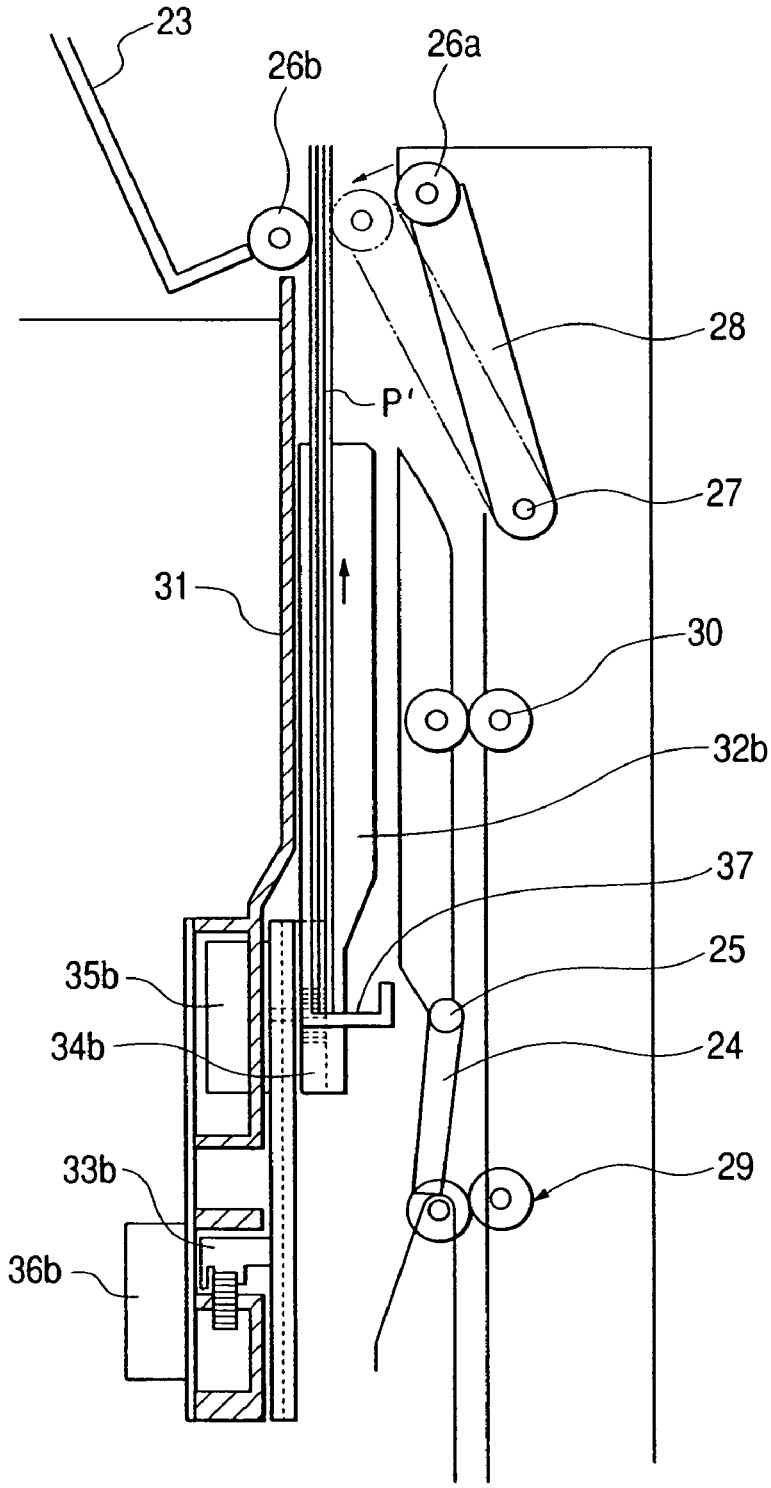
FIG. 5 is an explanatory view of a state of moving an intermediate treatment tray upward.
Figure 6:
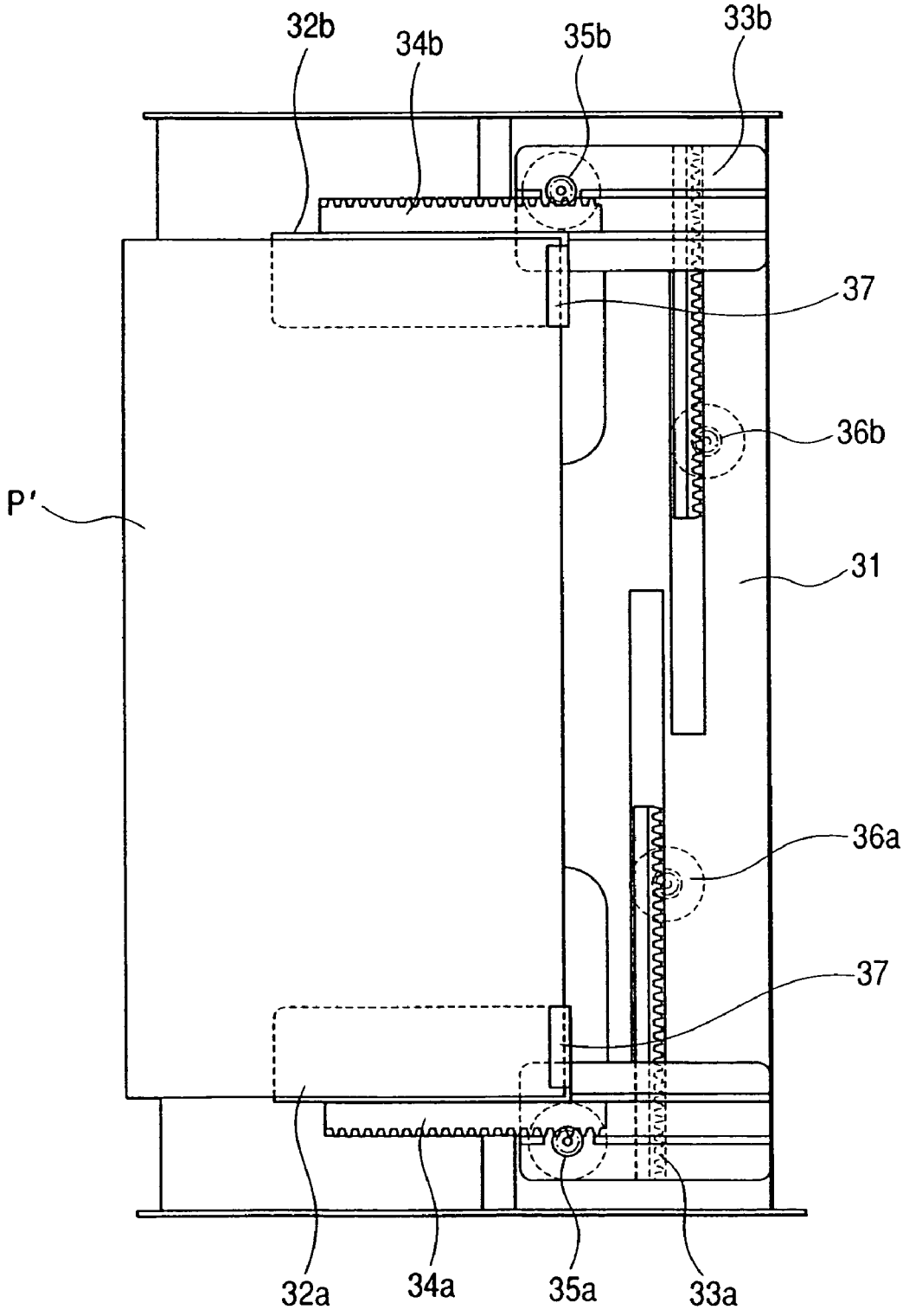
FIG. 6 is an explanatory view of a state of moving the intermediate treatment tray upward.

When the leading edge of the sheet stack P' goes out of the sheet-stack delivery roller 26*b*, the swing guide 28 is pressed to a position indicated by the double-dotted line of FIG. 5, and the sheet stack P' is delivered to the delivery tray 23 by the pair of sheet-stack delivery rollers 26*a* and 26*b*.

Subsequently, the front and rear aligning plates 32*a* and 32*b* are moved downward by reverse-rotation of the sheet-stack delivery motors 35*a* and 35*b*. When the movement down to a predetermined position is detected by a position sensor (not shown), the sheet-stack delivery motors 35*a* and 35*b* stop driving, and prepare post-treatment for a next job.

The embodiment shows the example of stapling carried out as sheet post-treatment by the staple unit. However, the sheet post-treatment is not limited to stapling. For example, needless to say, punching (treatment for cutting holes in a sheet) can be carried out by providing a punch unit.

(Sheet Delivery Portion)

As shown in FIG. 1, a plurality of delivery trays 23 provided above the image reading portion 1 of the embodiment are arranged in a transverse direction (a direction intersecting a sheet delivering direction and a horizontal direction in the embodiment) in a state of being obliquely upright. Each of the delivery trays 23 is moved from left to right by a spiral groove lead cam 38 rotated in a direction indicated by the arrow "c" by a driving source 61, and a guide rail 39*a* provided in a rear plate 39 for supporting a rear side of the delivery tray 23.

That is, a roller 40 is provided in a lower end of both front and rear ends of each delivery tray 23 to be engaged with the groove of the lead cam 38, and the delivery tray 23 can be moved in the transverse direction by rotation of the lead cam 38. Then, a tray position is detected by a position detecting sensor (not shown), and stopped in a predetermined position. Thus, the sheet delivered by the pair of delivery rollers 26*a* and 26*b* is delivered to a predetermined delivery tray 23.

In the above-described delivery, on a sort mode, the delivery trays 23 are sequentially moved in association with sheet delivery, and thus sheets are delivered to the plurality of delivery trays 23 in a sorted state. On the other hand, on a non-sort mode, the rightmost delivery tray 23 shown in FIG. 1 is moved to a position for receiving the sheet, and the sheet is delivered to that tray.

Since the plurality of delivery trays are arranged in the transverse direction as described above, the delivered sheets can be easily taken out. As the delivered sheet is supported by the delivery tray 23, the delivered sheet is set obliquely upright. Thus no delivery space is needed in the transverse direction even if a sheet size is large.

{Opening/Closing of Image Reading Portion}

In the embodiment, since the delivery tray 23 is arranged above the image reading portion 1, when opened upward, the entire original reading portion may hit against the delivery tray 23. Thus, an opening/closing constitution of the image reading portion is constructed as follows.

(Opening/Closing of Original Pressing Portion)

The ADF 4*b* arranged above the scanning optical system 4*a* of the embodiment can also read an original by a sheet-through type. That is, in FIG. 1, sheet originals set on an original tray portion 62 are U-turn transported one by one by an original transporting portion 63 composed of rollers such as a pickup roller 63*a*, a transport roller 63*b* and an original pressing roller 63*c*, and an original guide, and delivered to a delivery tray portion 64. Before this U-turn transportation, the light source 6 and the scanning mirror 7 of the scanning optical system 4*a* are moved to positions opposite the original pressing roller 63*c*, and the original to be transported is read by light irradiation.

Figure 7B:
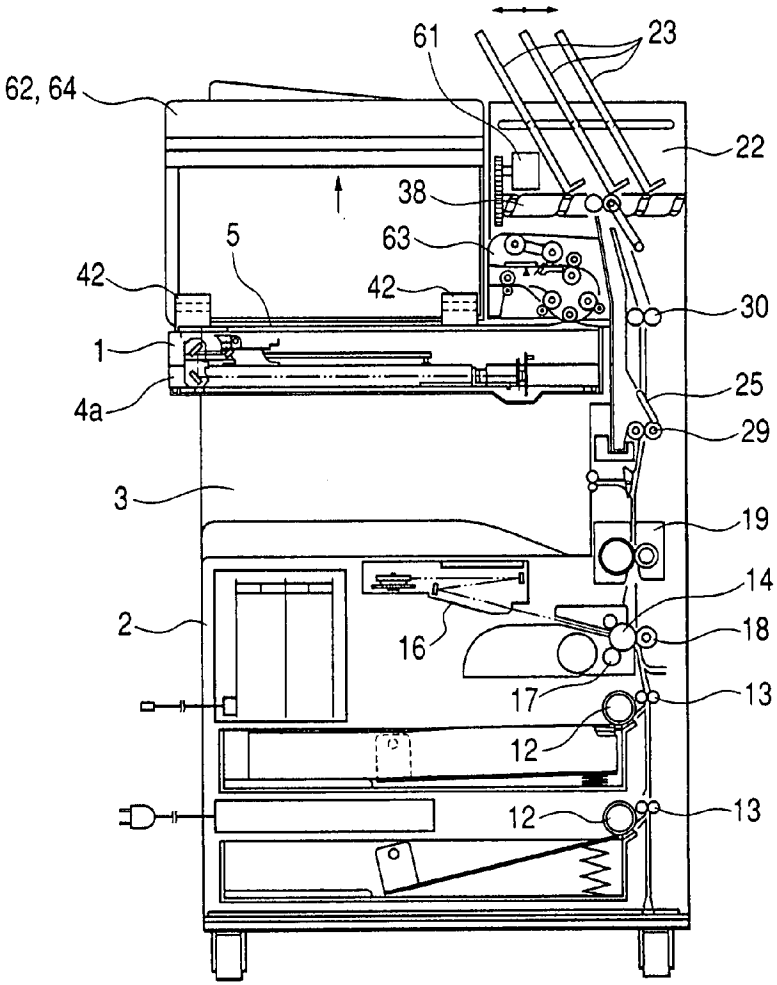
FIGS. 7A and 7B are a left side view and a sectional view, each showing a state where an original pressing portion of an ADF is opened.
Figure 7A:
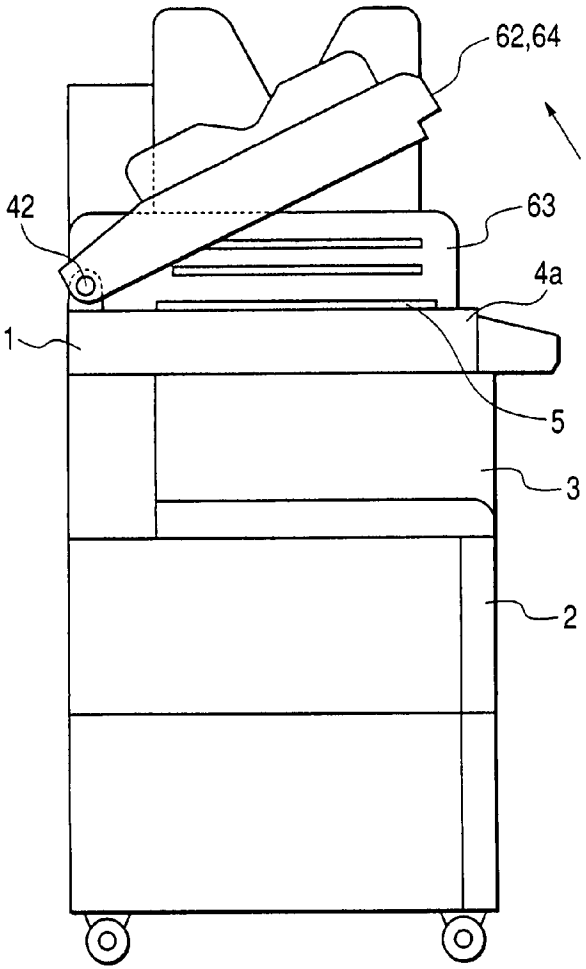

In the above-described constitution, the original transporting portion 63 is fixed to the apparatus main body, and the upper delivery portion 22 is located above it. On the other hand, the original tray portion 62 and the delivery tray portion 64 are separated from the original transporting portion 62, and no delivery portions 22 are located above them. As shown in FIGS. 7A and 7B, the original tray portion 62 and the delivery tray portion 64 are integrally rotated around a rotary hinge portion 42, and can be opened upward with respect to the scanning optical system 4*a*.

Accordingly, to read a book original or the like, by opening the original tray portion 62 and the delivery tray portion 64 while the scanning optical system 4*a* is fixed, the original can be set on the platen glass plate 5, and read. In this case, the original tray portion 62 and the delivery tray portion 64 function as original pressing portions.

The openable and closable original pressing portions are light in weight because they are formed only by trays (the original tray portion 62 and the delivery tray portion 64), and advantageous in that a constitution of a hinge or the like can be simplified, and high operability can be provided.

(Opening/Closing of Scanning Optical System)

Figure 8B:
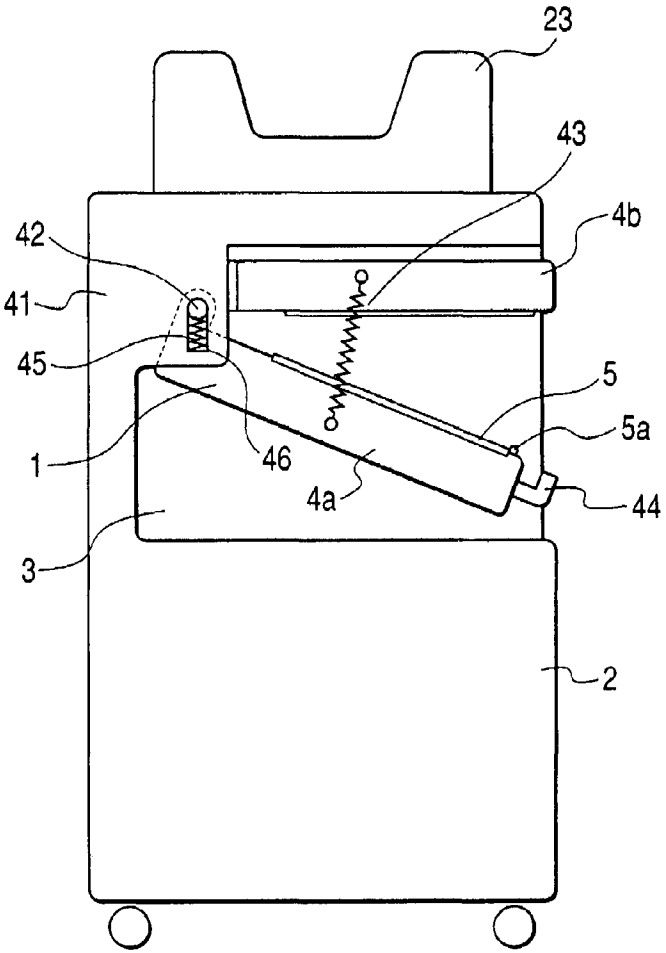
FIGS. 8A and 8B are side explanatory views, each showing a main body of the image forming apparatus of the first embodiment when seen from a left side.
Figure 8A:
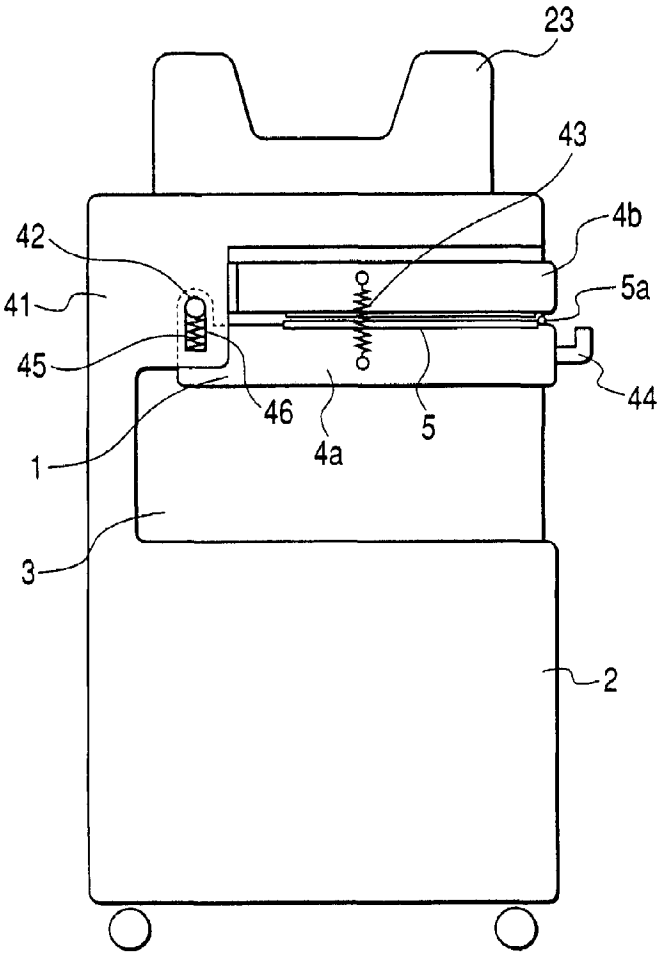

In the embodiment, as shown in FIGS. 8A and 8B, the scanning optical system 4*a* can be moved to the delivery space portion 3 (moved in the direction indicated by the arrow "d" in FIG. 1). FIGS. 8A and 8B are side explanatory views when the main body of the image forming apparatus of the embodiment is seen from the left side.

As shown in FIGS. 8A and 8B, the ADF 4*b* is fixed to the apparatus housing 41, and the image reading portion 1 provided with the scanning optical system 4*a* is constructed in such a manner that the scanning optical system 4*a* can be rotated around the rotary hinge portion 42 as a fulcrum with respect to the ADF 4*b*. In a normal state, the image forming portion 1 is pulled up and fixed in a position shown in FIG. 8A by a tension spring 43.

In the case of image reading carried out by the operator by setting the original on the platen glass plate 5 of the image reading portion 1, when a grip 44 provided on the scanning optical system 4*a* on the front side of the apparatus is depressed, as shown in FIG. 8A, the scanning optical system 4*a* is rotated around the rotary hinge portion 42 to an area of the delivery space portion 3, exposing the platen glass plate 5. In this state, the original is aligned with a hit reference 5*a* formed on the platen glass plate 5 on the front side of the apparatus.

Then, when the scanning optical system 4*a* is returned by holding the grip 44, as shown in FIG. 8A, the scanning optical system 4*a* is pressed to the ADF 4*b* by a tensile force of the tension spring 43, and scan-reading is carried out in this state.

The tension spring 43 is locked between the original transporting portion 63 and the scanning optical system 4*a* fixed to the apparatus main body. No tensile forces are applied by the tension spring 43 when the original tray portion 62 and the delivery tray portion 64 are opened upward as described above.

Figure 9B:
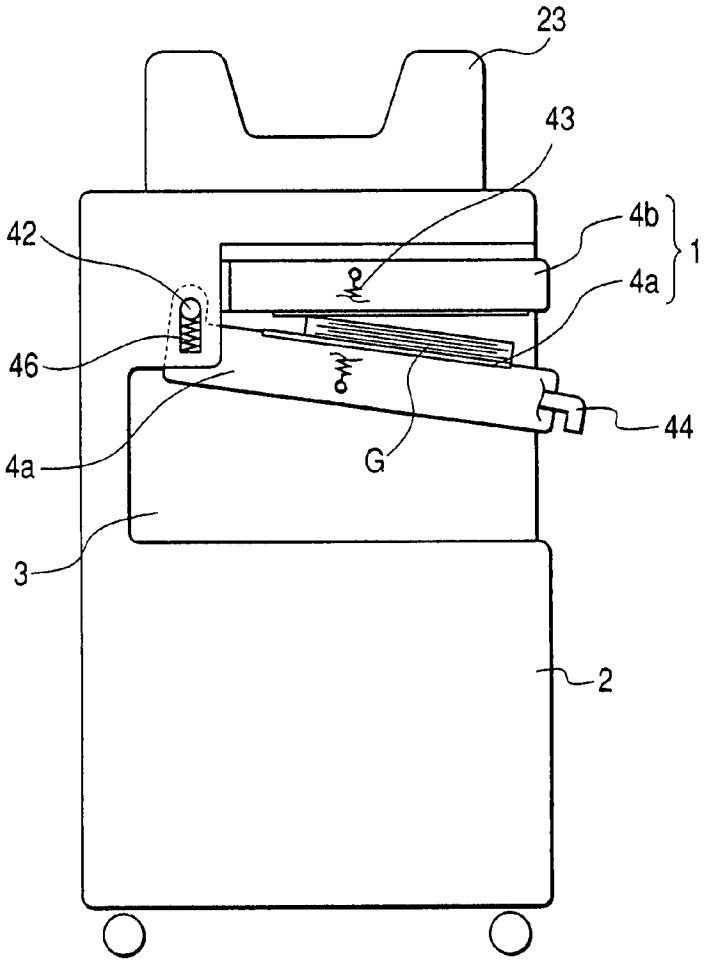
FIGS. 9A and 9B are explanatory views, each showing a state when a thick original is read.
Figure 9A:
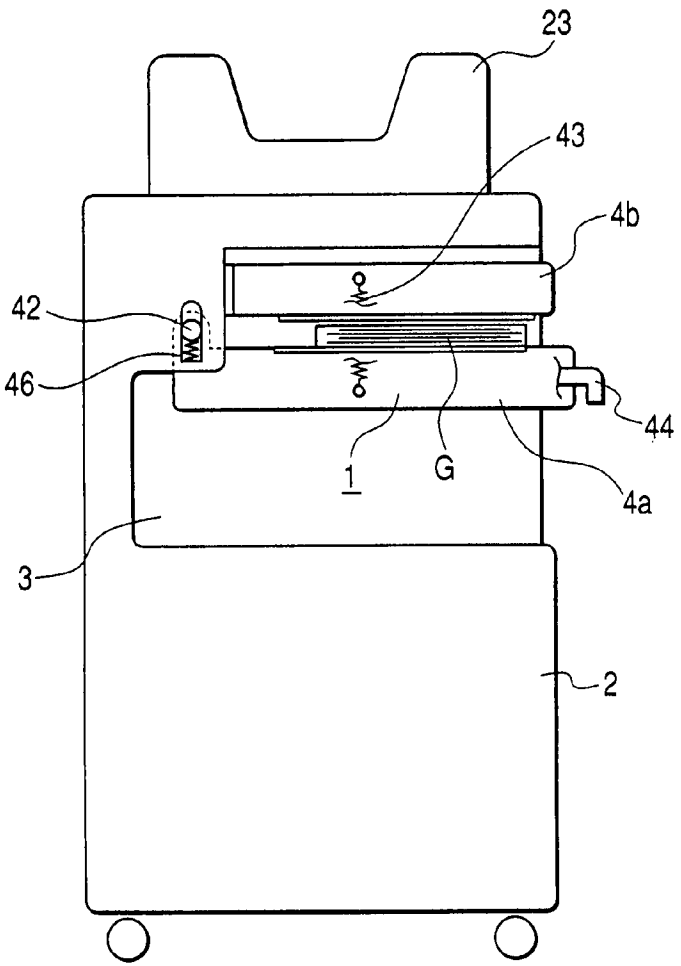

The rotary hinge portion 42 is movable within a range of a longitudinal hole 45 formed in the apparatus housing 41, and pressed to an upper edge side of the longitudinal hole 45. Accordingly, as shown in FIGS. 9A and 9B, when a thick book original G is set on the platen glass plate 5, a compression spring 46 provided in the rotary hinge portion 42 of the image reading portion 1 is compressed, thereby pressing the thick original in parallel.

As described above, by making the image reading portion 1 movable to the area of the delivery space portion 3, the original can be set without moving the delivery tray 23 arranged above the image reading portion 1. Thus, it is possible to save space for the apparatus without losing visual recognizability or taking-out operability of the sheet delivered to the delivery tray 23.

As described above, when the original is set on the entire platen glass plate 5, as shown in FIGS. 8A and 8B, the ADF 4*b* is fixed, the scanning optical system 4*a* is opened to the delivery space portion 3 side, and the original is set. In the case of setting an original of a size not reaching the original transporting portion 63, as shown in FIGS. 7A and 7B, the scanning optical system 4*a* is fixed, the original tray portion 62 and the original transporting portion 63 as the original pressing portions are opened upward, and then the original can be set.

Second Embodiment

Figure 10:
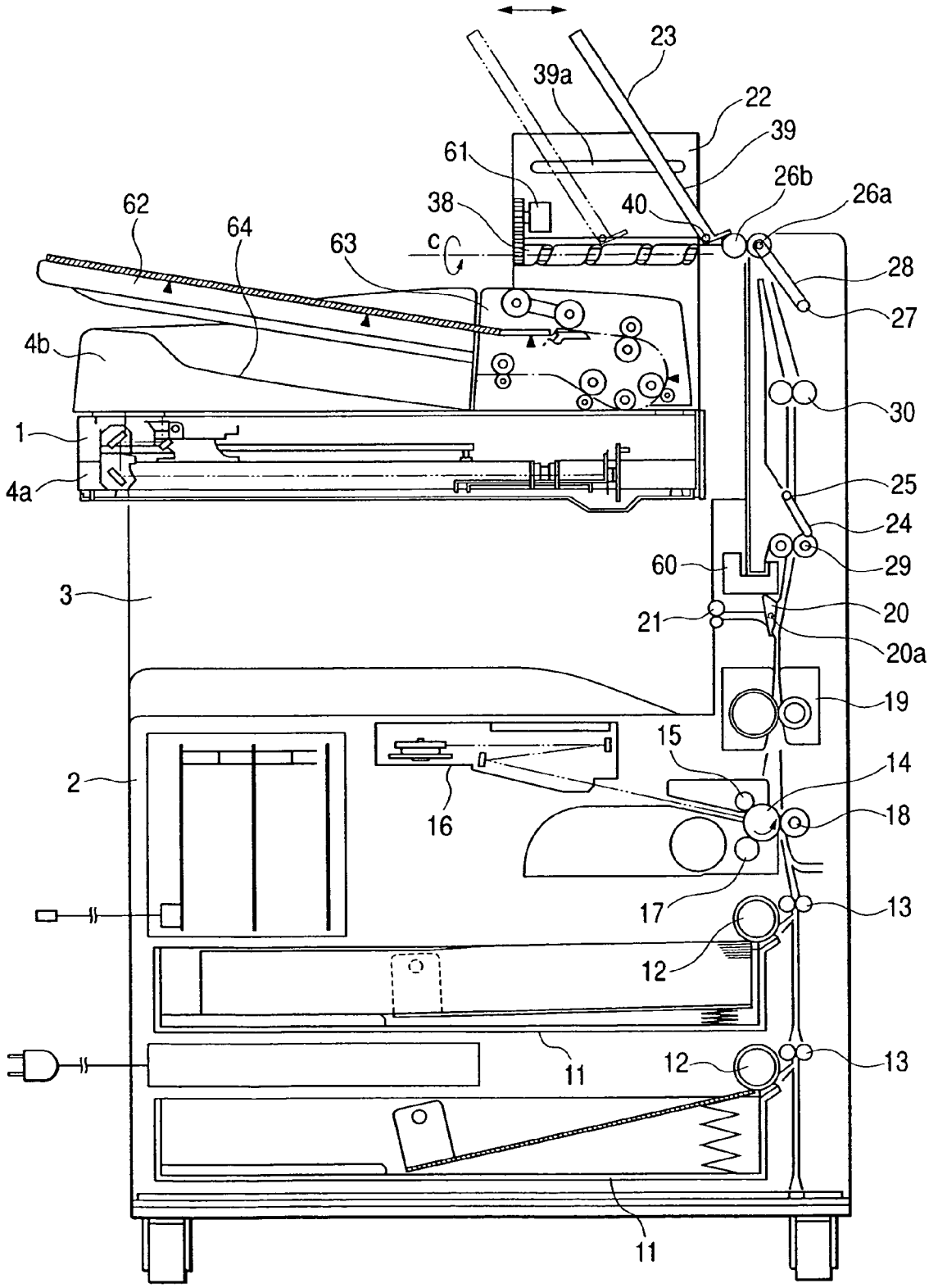
FIG. 10 is a sectional explanatory view showing an entire image forming apparatus having a single delivery tray according to a second embodiment.

The above-described first embodiment showed the example where the plurality of delivery trays 23 were provided in the delivery portion 22 arranged above the sheet post-treating portion. However, as shown in FIG. 10, one delivery tray 23 may be provided in the delivery portion 22. FIG. 10 is a schematic explanatory view showing an image forming apparatus according to a second embodiment. Members having functions similar to those of the first embodiment are denoted by similar reference numerals.

In the second embodiment, the delivery tray 23 is moved according to the volume of sheets to be delivered to the delivery tray 22, and the sheets to be delivered are held upright.

Third Embodiment

Figure 11:
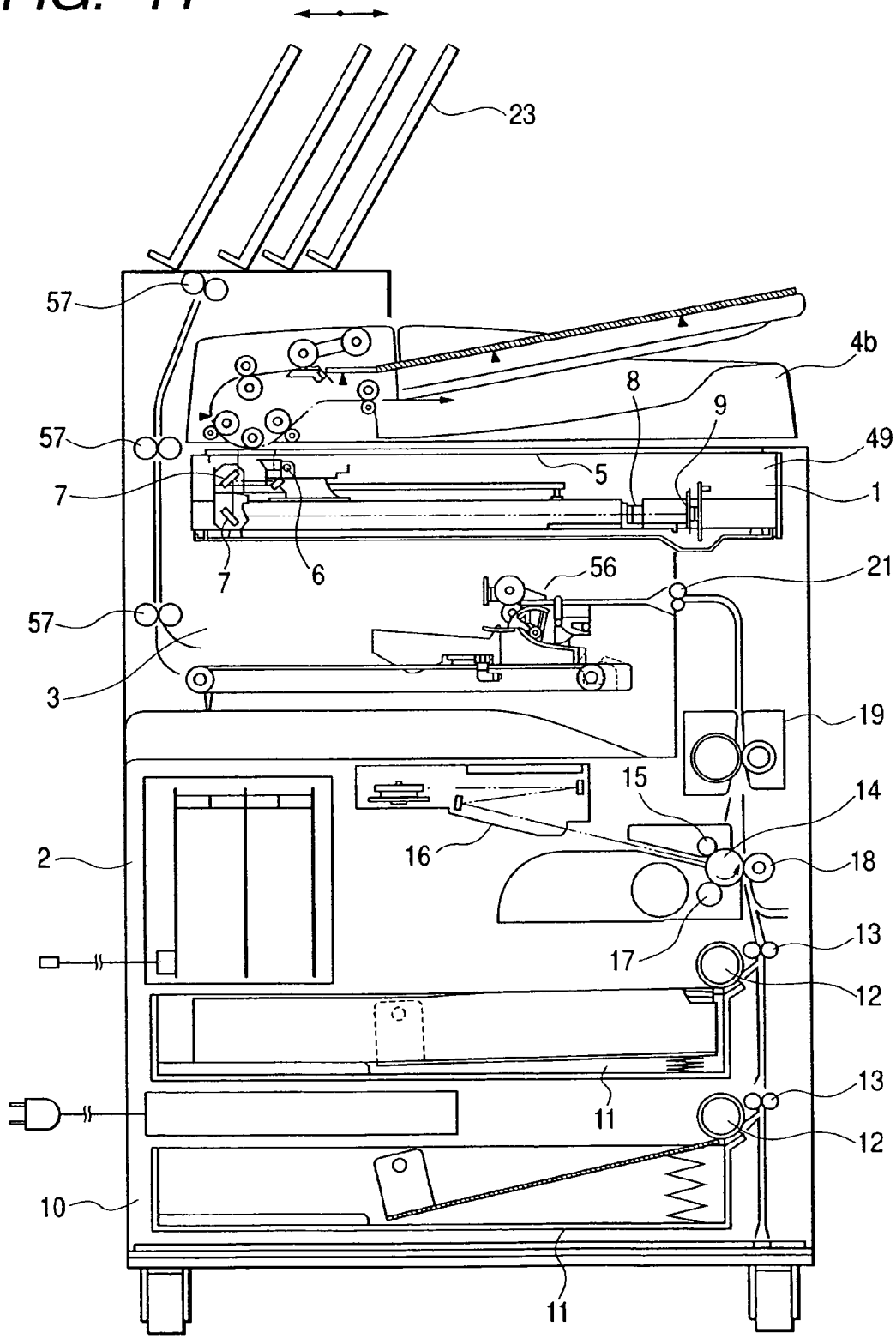
FIG. 11 is a constitutional explanatory view showing another moving mode of an image reading portion according to a third embodiment.

FIG. 11 is a schematic explanatory view of an image forming apparatus according to a third embodiment, showing an example where a sheet treating apparatus is arranged in a delivery space portion 3. Other components are similar to those of the above-described first embodiment (members having functions similar to those of the first embodiment are denoted by similar reference numerals).

In the third embodiment, a sheet passed from a fixing device 19 through a main body delivery roller 21 is subjected to post-treatment such as stitching by staples or the like at a sheet post-treating portion 56, and then delivered and stacked to a delivery tray 23 arranged above an image reading portion 1 by a delivery roller 57.

As in the case of the above-described first embodiment, the sheet post-treating portion 56 aligns sheets sequentially delivered by the delivery roller 21 thereto in a cross direction by aligning means to form a sheet-stack. After it is subjected to stapling by a staple unit, the sheet-stack is held by a gripper (not shown) or the like and transported, and further transported upward by the delivery roller 57 and delivered to the delivery tray 23.

The image reading portion 1 can be pulled out to the front side of the apparatus main body. When reading is carried out at the image reading portion 1 by opening an ADF 4*b*, the operation is executed by pulling the image reading portion 1 to the front side.

In the embodiment, treatment can be carried out by arranging the sheet post-treating portion 56 substantially horizontally to a delivery space portion 3, and setting a sheet substantially horizontal. Thus, it is possible to install a sheet treating apparatus for performing various treatments such as large-volume stapling, two-position stitching and punching.

Fourth Embodiment

{Sheet Treating Means}

Figure 13B:
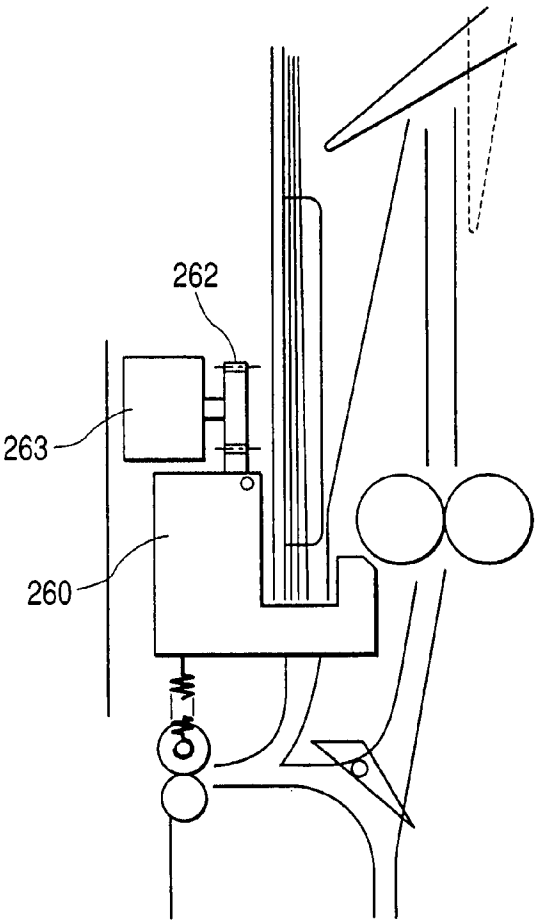
FIGS. 13A and 13B are explanatory views, each showing a hit reference member, on which a lower end of a sheet contained in an intermediate treatment tray is hit.
Figure 13A:
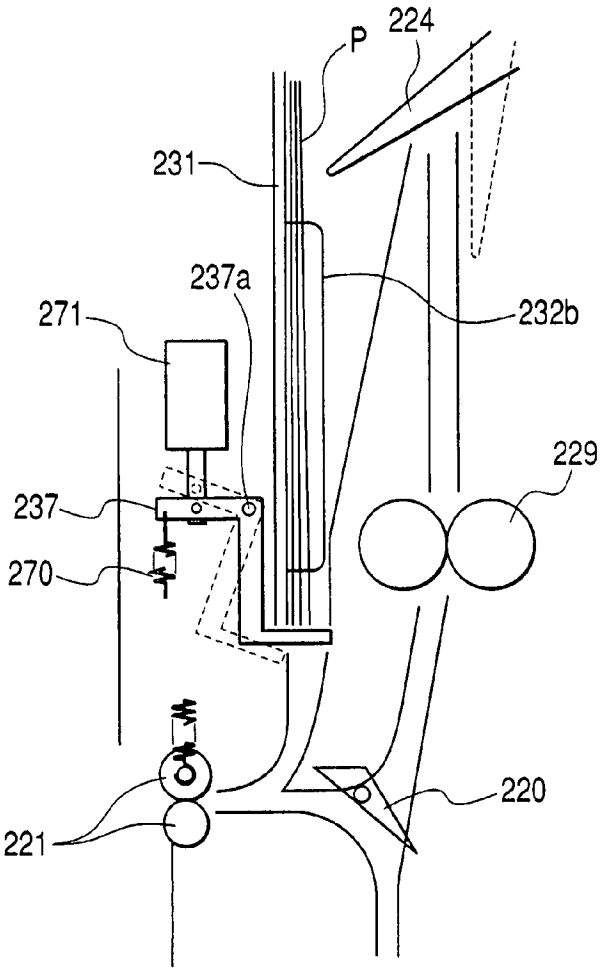
Figure 14:
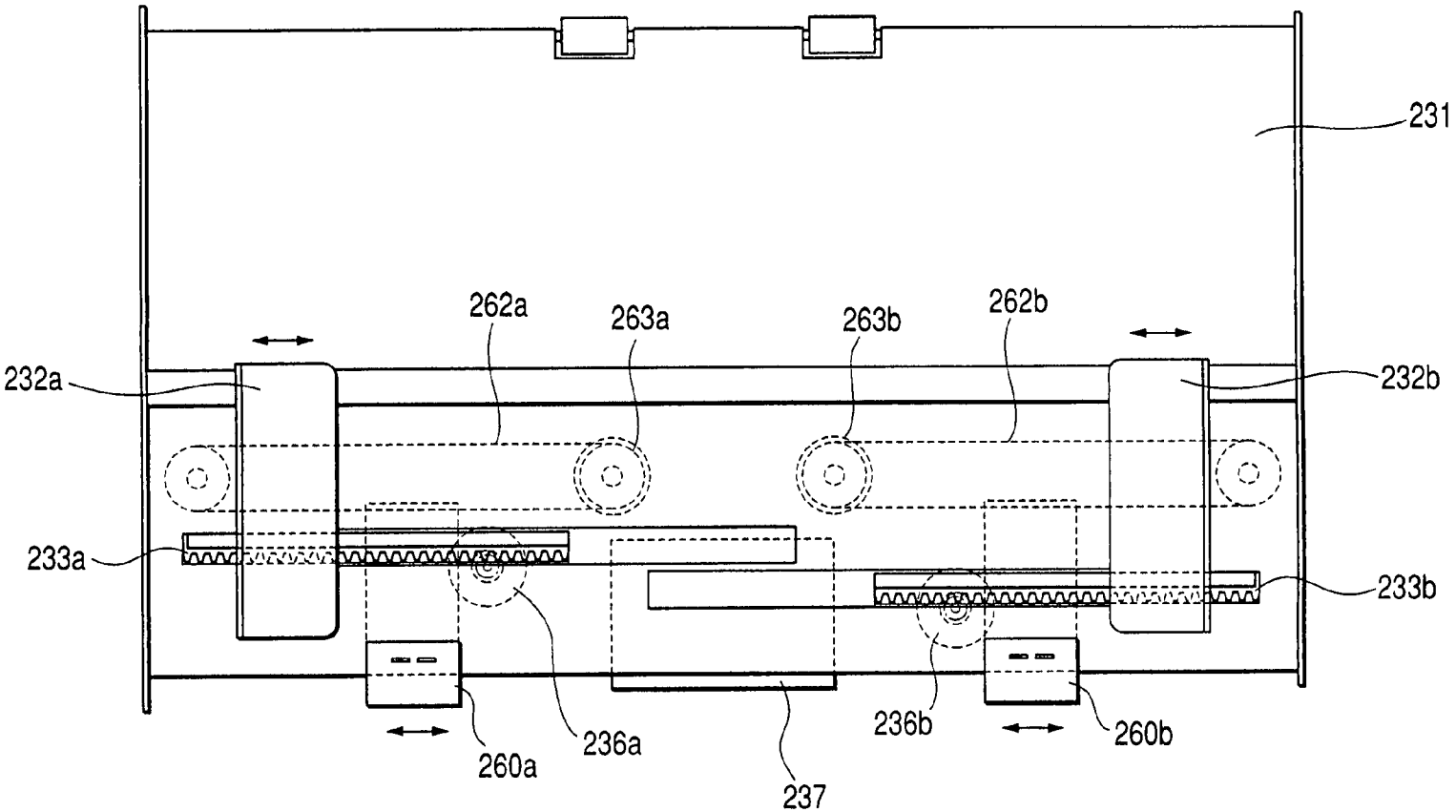
FIG. 14 is an explanatory view of aligning means.

Next, description will be made of a constitution of a sheet treating apparatus for executing treatment such as punching or stapling according to a fourth embodiment with reference to FIGS. 12 to 14. The sheet treating apparatus of the embodiment transports sheets having images formed thereon into an intermediate treatment tray having a substantially vertical stacking surface, aligns the sheets to form a sheet-stack, and delivers the sheet-stack to a delivery space portion 3 after stapling. FIGS. 13A and 13B are explanatory views of a hit reference member, against which a lower end of a sheet contained in the intermediate treatment tray is hit, and stapling means; and FIG. 14 is a constitutional explanatory view of aligning means.

(Transportation Path)

Figure 12:
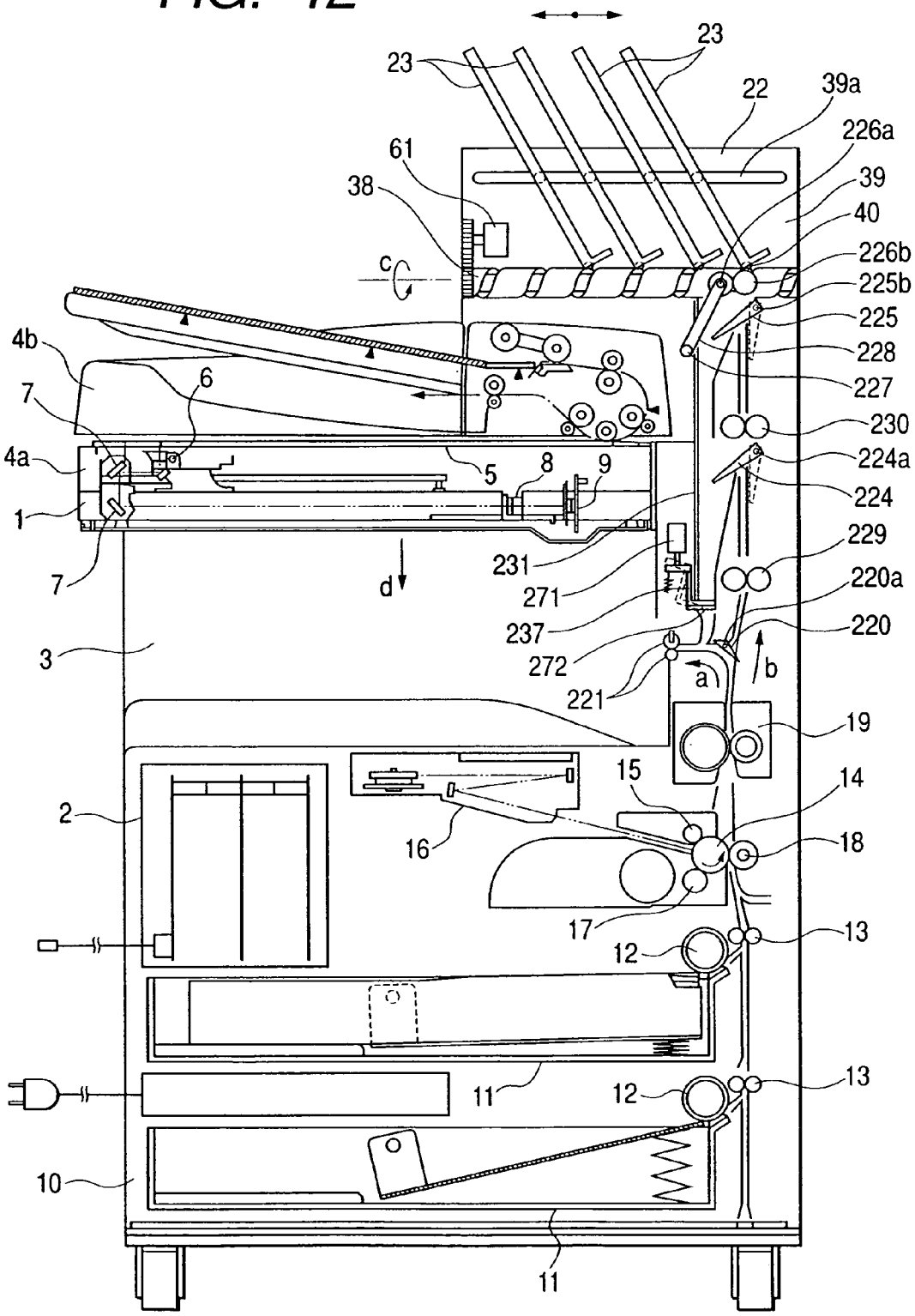
FIG. 12 is a sectional explanatory view showing an entire image forming apparatus according to a fourth embodiment.

The sheet transported by a first changeover flapper 220 in a direction indicated by the arrow "b" of FIG. 12 is then changed over for a transporting direction by a second changeover flapper 224 rotated around a fulcrum 224*a* and a third changeover flapper 225 rotated around a fulcrum 225*a* depending on the presence or absence of post-treatment.

That is, in the case of a job needing no sheet treatment such as stitching (stapling) or punching (treatment for cutting holes in a sheet), the second and third changeover flappers 224 and 225 are respectively rotated to positions indicated by the double-dotted lines in FIGS. 12, 13A and 13B. At this time, a delivery roller 226*a* is supported by a swing guide 228 swung around a fulcrum 227, and rotated to a position shown in FIG. 12, thereby constituting a transportation path.

The sheet is transported by first and second transport roller pairs 229 and 230 as transporting means to a pair of delivery rollers 226*a* and 226*b* located above substantially vertically, delivered through the upper transportation path, and delivered and stacked on a delivery tray 23 located substantially vertically above an image forming portion 2.

Then, in the case of a job needing sheet treatment, the second and third changeover flappers 224 and 225 are rotated to transport the sheet to an intermediate treatment tray 231. In a lower part of the intermediate treatment tray 231, a hit reference member 237 is provided, against which lower ends of sheets contained in the tray 231 are hit to be aligned in upper and lower directions.

For sheet transportation to the intermediate treatment tray 231, operations of the changeover flappers 224 and 225 are different from each other depending on a sheet size.

(Transportation Path of Small Size Sheet)

If a set sheet size is small, the second changeover flapper 224 is initially in a state indicated by the broken line of FIG. 12. However, when a sheet trailing end is passed through the second changeover flapper 224 to reach just before a nip of the second transport roller pair 230, the flapper is rotated in a state indicated by a solid line in FIG. 12. Simultaneously, the second delivery roller pair 230 is rotated reversely. Thus, a lower end of the sheet is guided as a sheet leading edge to the intermediate treatment tray 231. The sheet guided to the intermediate treatment tray, 231 is stopped by its lower end hit against the hit reference member 237, and stacked.

By repeating this operation for each sheet transported in, sheets aligned in upper and lower directions can form a sheet-stack in the intermediate treatment tray 231.

(Transportation Path of Large Size Sheet)

On the other hand, if a set sheet size is larger, the second and third changeover flappers 224 and 225 are initially in states indicated by the broken lines of FIG. 12. However, when a sheet trailing edge is passed through the second changeover flapper 224, the second transport roller pair 230 and the third changeover flapper 225 to reach just before nips of the pair of delivery rollers 226*a* and 226*b*, the flappers are set in states indicated by the solid lines in FIG. 12. Simultaneously, the pair of delivery rollers 226*a* and 226*b* are rotated reversely. Thus, a lower end of the sheet is guided as a sheet leading edge to the intermediate treatment tray 231. The sheet guided thereto is stopped by its lower end hit against the hit reference member 237, and stacked.

By repeating this operation for each sheet transported in, sheets aligned in upper and lower directions can form a sheet-stack in the intermediate treatment tray 231.

(Hit Reference Member)

As shown in FIG. 13A, the hit reference member 237, against which the lower end of the sheet contained in the intermediate treatment tray 231 is hit, is formed in a crank shape to be rotated around a shaft 237*a*. It is tension-pressed by a tension spring 270, and stopped by a stopper (not shown) in a position (hitting position) indicated by the solid line in FIG. 13A. In this state, lower ends of sheets contained in the intermediate treatment tray 231 are hit against the hit reference member 237, and the sheets are aligned in upper and lower directions.

The hit reference member 237 is connected to a solenoid 271. When the solenoid is turned ON, the hit reference member 237 is pulled and rotated, and then retreated from the hitting position as indicated by the broken line in FIG. 13A (opening position). At this time, a lower end of the intermediate treatment tray 231 is opened, and a sheet transportation path to the delivery space portion 3 is opened as described later.

(Aligning Means)

As shown in FIG. 13B, sheets P transported into the intermediate treatment tray 231 are held in a substantially vertical state, and aligned, and then subjected to stapling by a staple unit 260 provided in a lower end. Accordingly, as shown in FIG. 14, in the intermediate treatment tray 231, aligning means is provided to align sheets in a cross direction i.e. in a front/rear direction of the apparatus for each sheet stacking. FIG. 14 shows a sheet cross direction (a direction orthogonal to a sheet transporting direction) up and down.

As shown in FIG. 14, the aligning means includes a front aligning plate 232*a* and a rear aligning plate 232*b* for aligning the front and rear sides (front and rear sides in FIG. 12) of the sheet cross direction. The front and rear aligning plates 232*a* and 232*b* are respectively provided to be reciprocated in the sheet cross direction (upper and lower directions of FIG. 14) of the intermediate treatment tray 231 integrally with width aligning racks 233*a* and 233*b*, and reciprocated in the sheet cross direction by the width aligning motors 236*a* and 236*b*.

Thus, the sheets transported into the intermediate treatment tray 231 are aligned in the sheet cross direction by the aligning means. During the aligning, a swing guide 228 supporting a delivery roller 226*a* is rotated around a fulcrum 227, and the delivery rollers 226*a* and 226*b* are separated from each other. Accordingly, because of the retreating of the delivery roller 226*a*, the pair of delivery rollers 226*a* and 226*b* are prevented from interfering with the sheet aligning in the intermediate treatment tray 231.

A staple unit 260 is provided to execute stapling for the sheet stack transported into the intermediate treatment tray 231, and aligned in the sheet cross direction by the aligning means. This staple units 260 (260*a* and 260*b*) are fixed to driving belts indicated by the broken lines 262 (262*a* and 262*b*) in FIG. 14, and can be moved in the sheet cross direction (a horizontal direction in FIG. 14) by motors 263 (263*a* and 263*b*) for driving the belts 262 (262*a* and 262*b*). Depending on a sheet size or a designated stitching position, the staple unit 260 is moved in the sheet cross direction, and then executes stitching. It is moved to the outside more than the aligning plate 232 to open the lower end of the intermediate treatment tray 231, and thereby the sheet transportation path to the delivery space portion 3 is opened as described later.

When the sheets are dropped to the intermediate treatment tray 231 by self-weight, and the lower ends thereof are hit against the hit reference member 237, the width aligning motors 236*a* and 236*b* are driven. The driving forces are transmitted to the width aligning racks 233*a* and 233*b* to move the front and rear aligning plates 232*a* and 232*b* in the sheet cross direction, and then aligning the sheets in the sheet cross direction is carried out. After the aligning, the front and rear aligning plates 232*a* and 232*b* are returned to standby positions. Thus, the sequentially delivered sheets are aligned one by one in the cross direction, and a predetermined number of sheets are stacked on the intermediate treatment tray 231 to form a sheet-stack.

After the alignment, for example, if stapling is instructed by the operation portion, the staple unit 260 carries out stapling by staples driven into the sheet-stack.

(In-Body Sheet-Stack Delivery)

The sheet-stack thus treated can be delivered to the delivery space portion 3. Accordingly, an in-body transportation path 272 is provided to guide the sheet-stack from the intermediate treatment tray 231 to the delivery space portion 3.

That is, the staple unit 260 shown in FIG. 14 is moved to the outside of the aligning plate by the motor 263, and the solenoid 271 shown in FIG. 13A is turned ON to set the hit reference member 237 of the intermediate treatment tray 231 in a state indicated by the broken line of FIG. 13A. Thus, the hit reference member 237 is retreated from an area of the in-body transportation path 272, and the sheet-stack is fallen with the aid of gravity to enter a nip area of the delivery roller pair 221. Then, by rotation of the delivery roller pair 221, the sheet-stack is delivered to the delivery space portion 3.

The sheet-stack having the sheets treated in the above-described manner can be delivered to the delivery space portion 3.

In the case of delivering the sheet-stack to the upper delivery tray 23, the swing guide 228 is swung to nip the sheet-stack by the pair of delivery rollers 226*a* and 226*b*, and then the sheet-stack can be delivered to a predetermined delivery tray 23 by rotating the pair of rollers 226*a* and 226*b*.

According to the embodiment, a size of a transporting sheet is detected by a well-known detecting mechanism and, accordingly, for example a sheet of a large size is delivered to the delivery space portion 3, and a sheet of a small size is delivered to the delivery tray 23 located above. Thus, the delivery tray 23 located in the upper side of the apparatus can be miniaturized and, by effectively using the delivery space portion 3, the entire apparatus can be made compact.

Moreover, presetting is carried out according to sheet types such that only a sheet-stack difficult to be sorted when sheet-stacks are combined is sorted and delivered to the plurality of delivery trays 23, and a sheet-stack sorted relatively easily and subjected to post-treatment is delivered to the delivery space portion 3. Thus, even if a great volume of sheets are stacked in each tray of the image forming apparatus, only a necessary sheet-stack can be taken out quickly.

Fifth Embodiment

Figure 15:
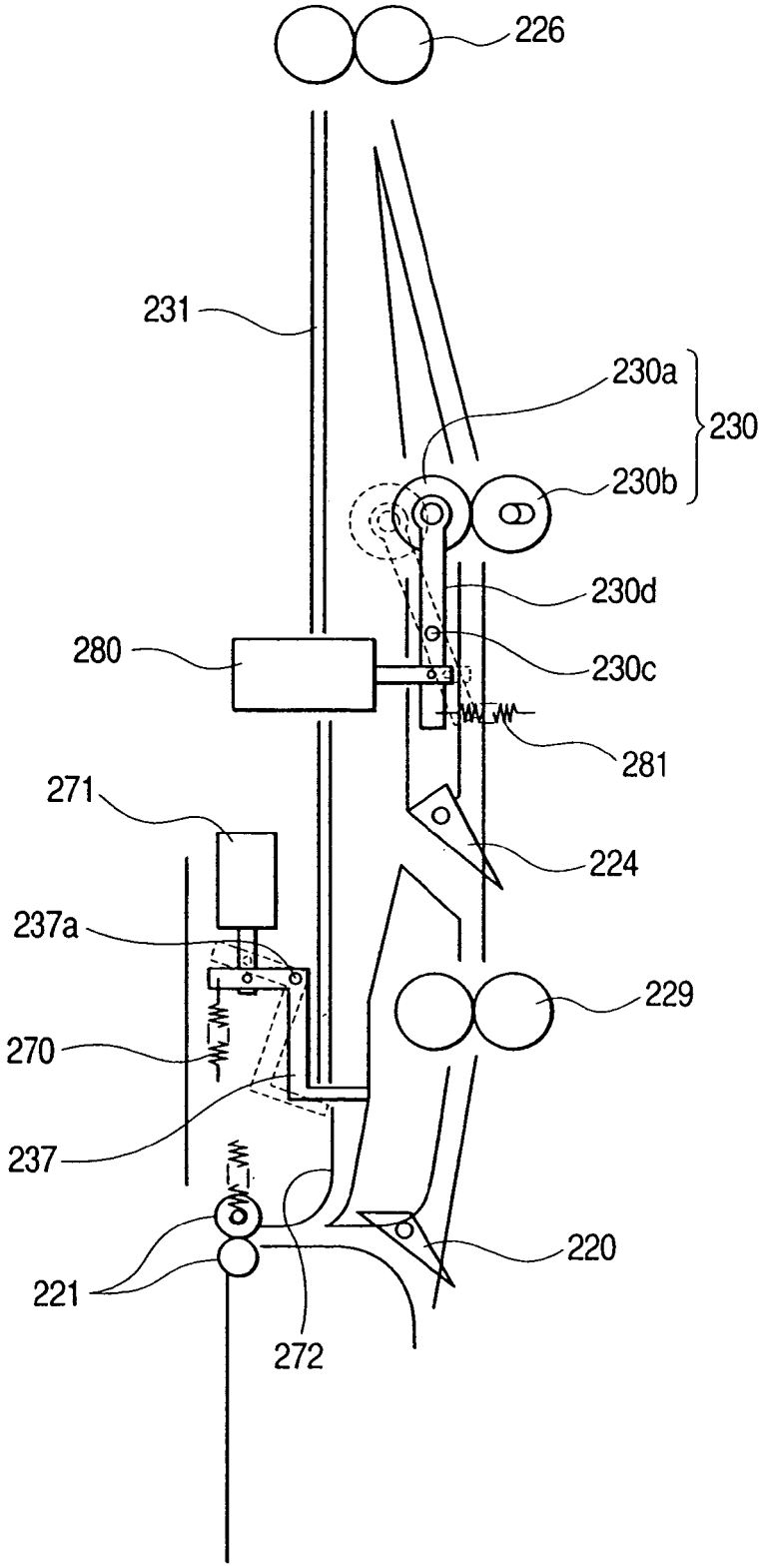
FIG. 15 is a schematic explanatory view showing sheet treating means according to a fifth embodiment.
Figure 16A:
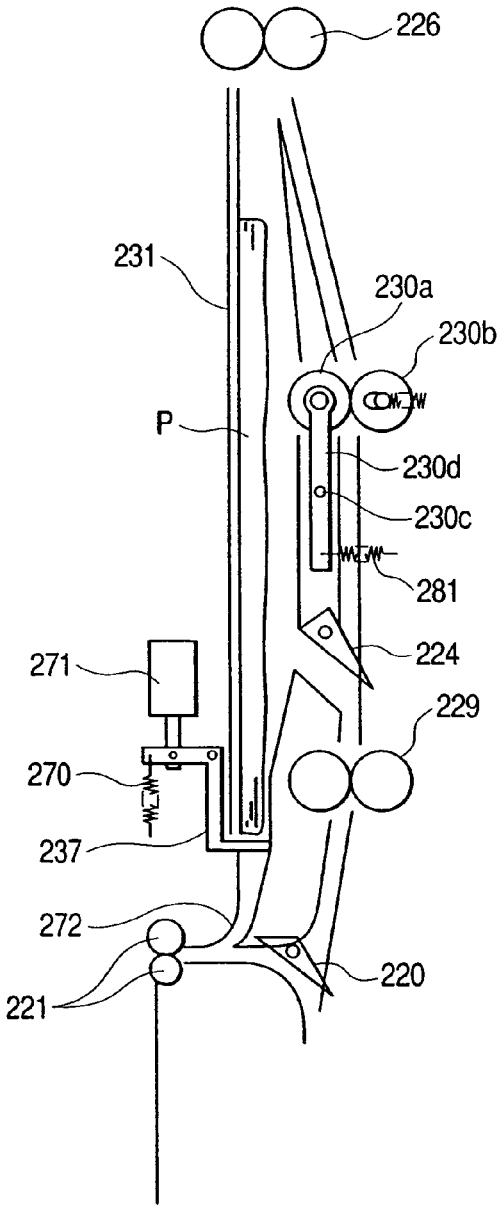
FIGS. 16A and 16B are explanatory views, each showing an operation of the sheet treating means of the fifth embodiment.
Figure 16B:
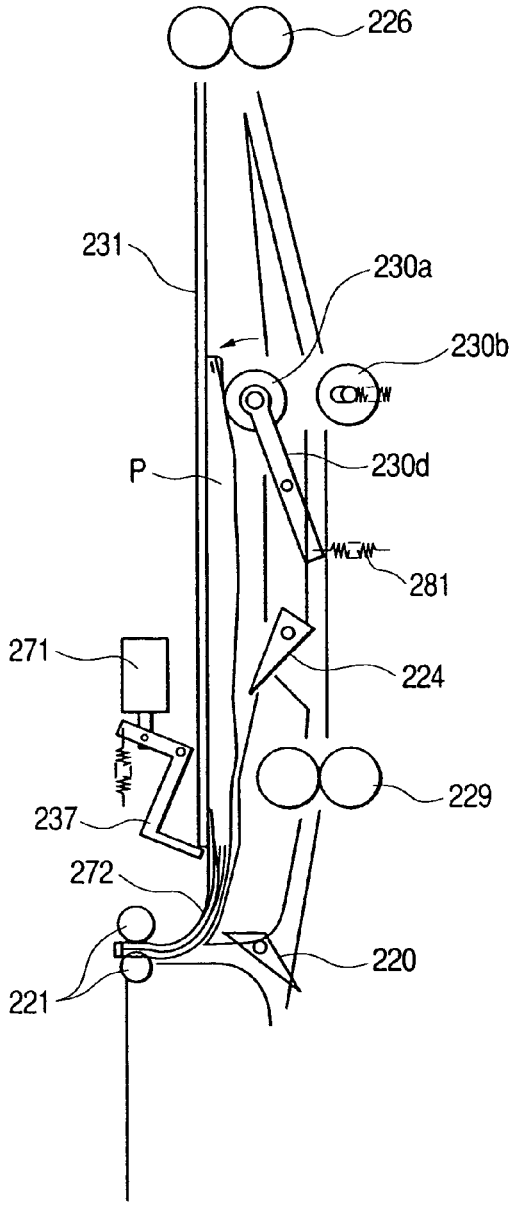

FIG. 15 and FIGS. 16A and 16B are schematic explanatory views of an image forming apparatus according to a fifth embodiment. Here, only components different from those of the fourth embodiment are described.

According to the embodiment, in a second transport roller pair 230 composed of transport rollers 230*a* and 230*b*, the transport roller 230*a* on an intermediate treatment tray 231 side is attached to a link member 230*d* rotated around a fulcrum 230*c*, and can be swung by a solenoid 280 between states respectively indicated by the solid and broken lines in FIG. 15. That is, the transport roller 230*a* pressed to the transport roller 230*b* by tension-pressing of a tension spring 281 is separated from the transport roller 230*b* by counterclockwise rotation of the link member 230*d* made by turning-ON of the solenoid 280.

In any state, a driving force is transmitted from a motor (not shown) to the transport roller 230*a*, and the transport roller 230*a* can be rotated counterclockwise in FIG. 15.

Here, as shown in FIG. 16A, the process is similar to that of the first embodiment until a sheet-stack is placed in the intermediate treatment tray 231, and subjected to treatment such as stapling. Then, after the end of sheet post-treatment, as shown in FIG. 16B, a hit reference member 237 of the intermediate treatment tray 231 is retreated from an area of an in-body transportation path 272. Simultaneously, the solenoid 280 is turned ON to rotate the transport roller 230*a* counterclockwise.

Accordingly, the transport roller 230*a* is pressed to the sheet-stack in the intermediate treatment tray 231 and, by rotation of the transport roller 230*a*, the sheet-stack is fed into a nip area of a delivery roller pair 221. Then, the delivery roller pair 221 is rotated to deliver the sheet-stack to the delivery space portion 3.

Thus, by providing transporting means to feed the sheet-stack to the nip area of the delivery roller pair 221, it is possible to transport the sheet-stack to the delivery space portion 3 more surely compared with the fourth embodiment.

Sixth Embodiment

Now, a sixth embodiment will be described with reference to FIGS. 17A, 17B, 18A, and 18B. Also here, only components different from those of the fourth embodiment are described.

Figure 17A:
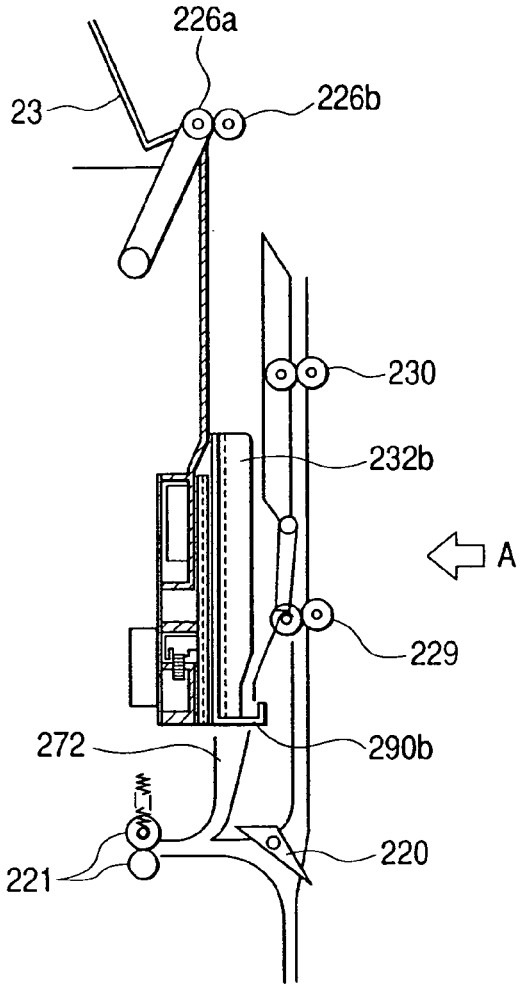
FIGS. 17A and 17B are views showing sheet treating means of an image forming apparatus according to a sixth embodiment.
Figure 17B:
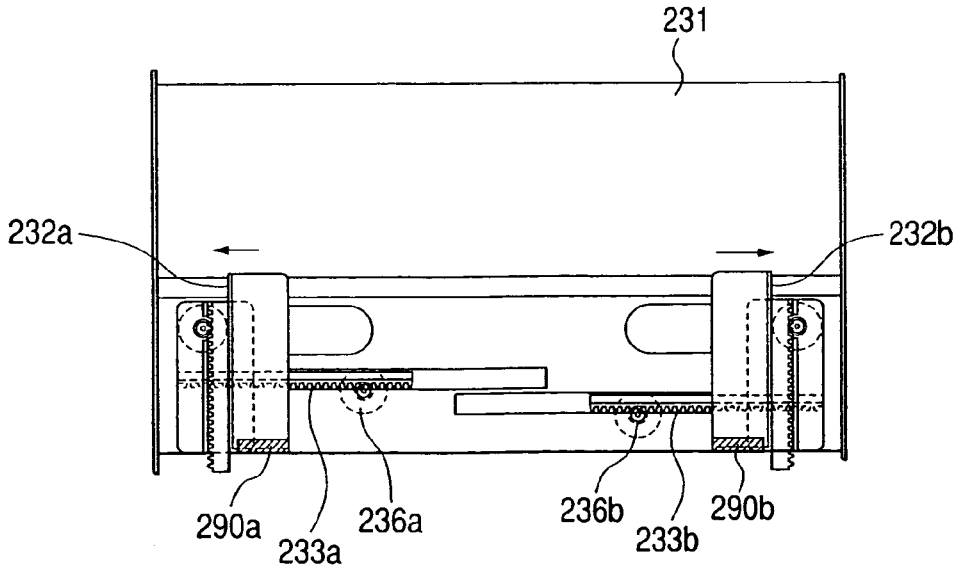
Figure 18A:
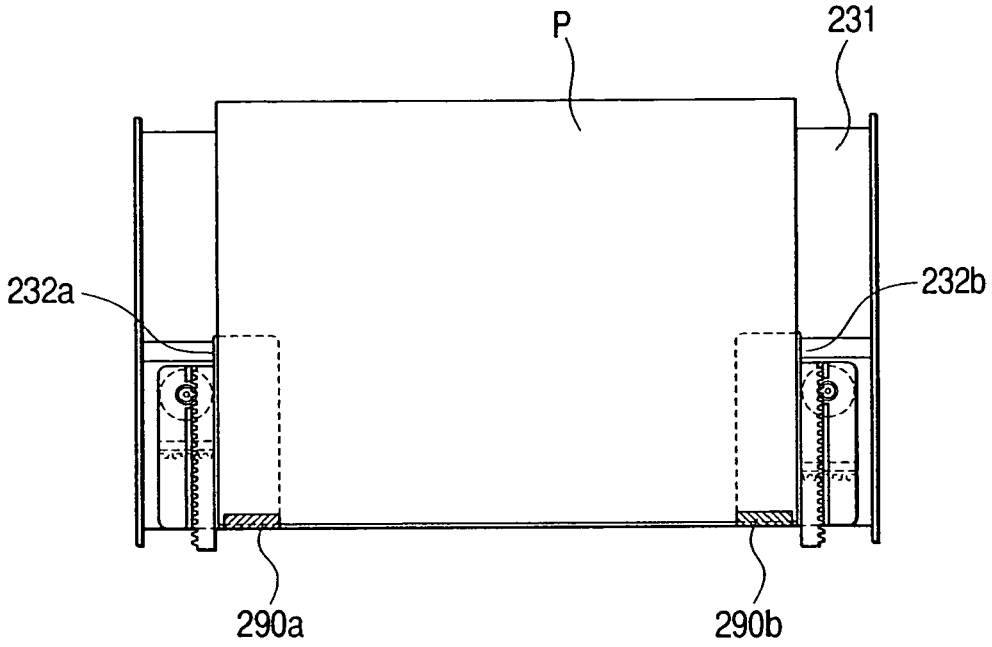
FIGS. 18A and 18B are views showing aligning means.
Figure 18B:
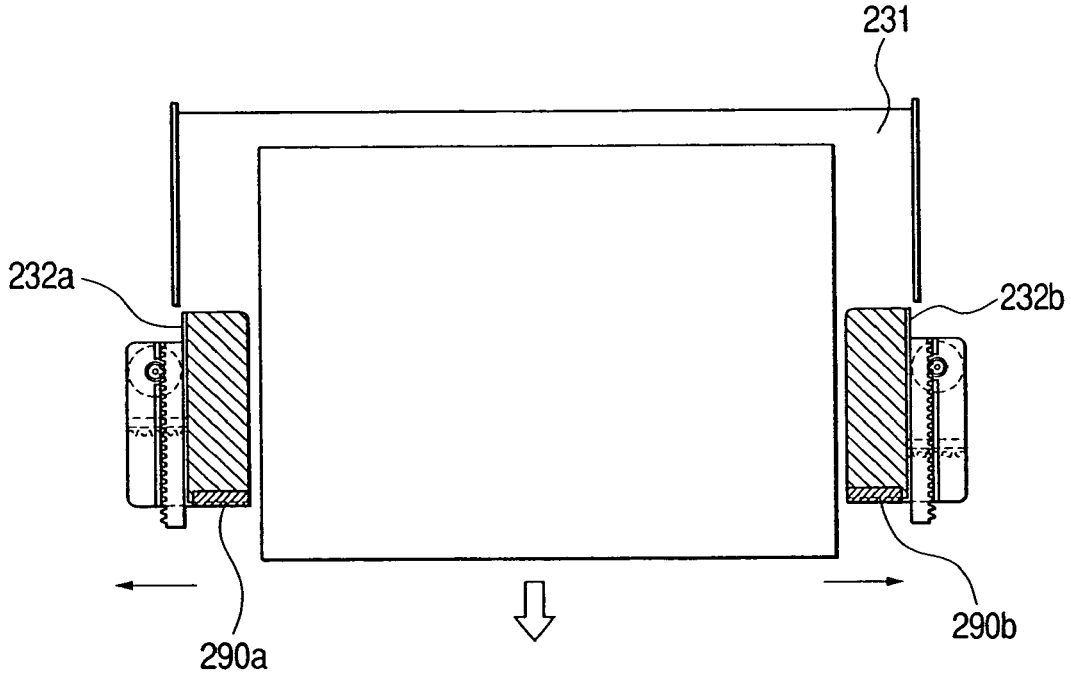
Figure 19:
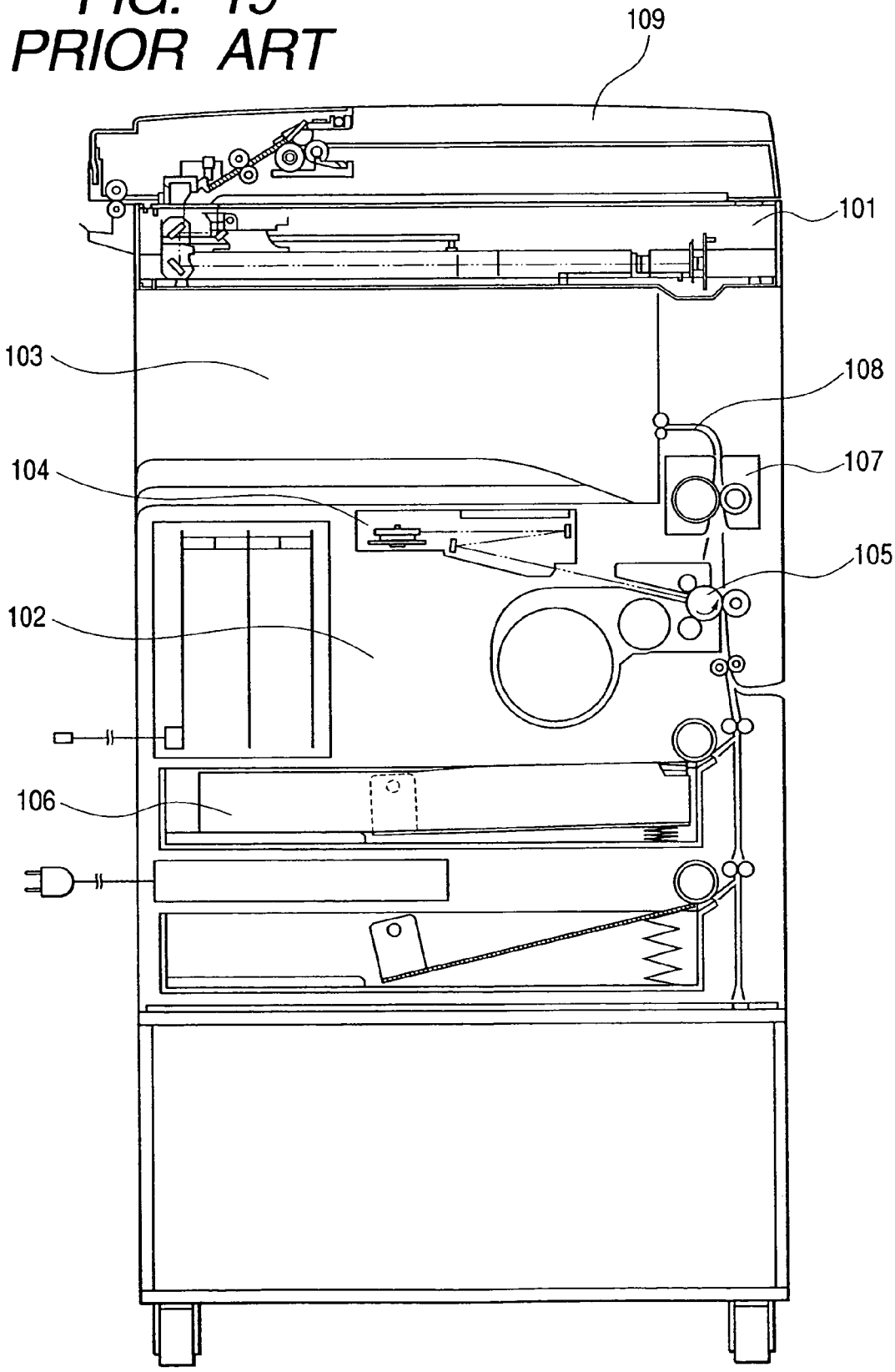
FIG. 19 PRIOR ART
FIG. 19 is an explanatory view showing an image forming apparatus of a conventional art.
Figure 20:
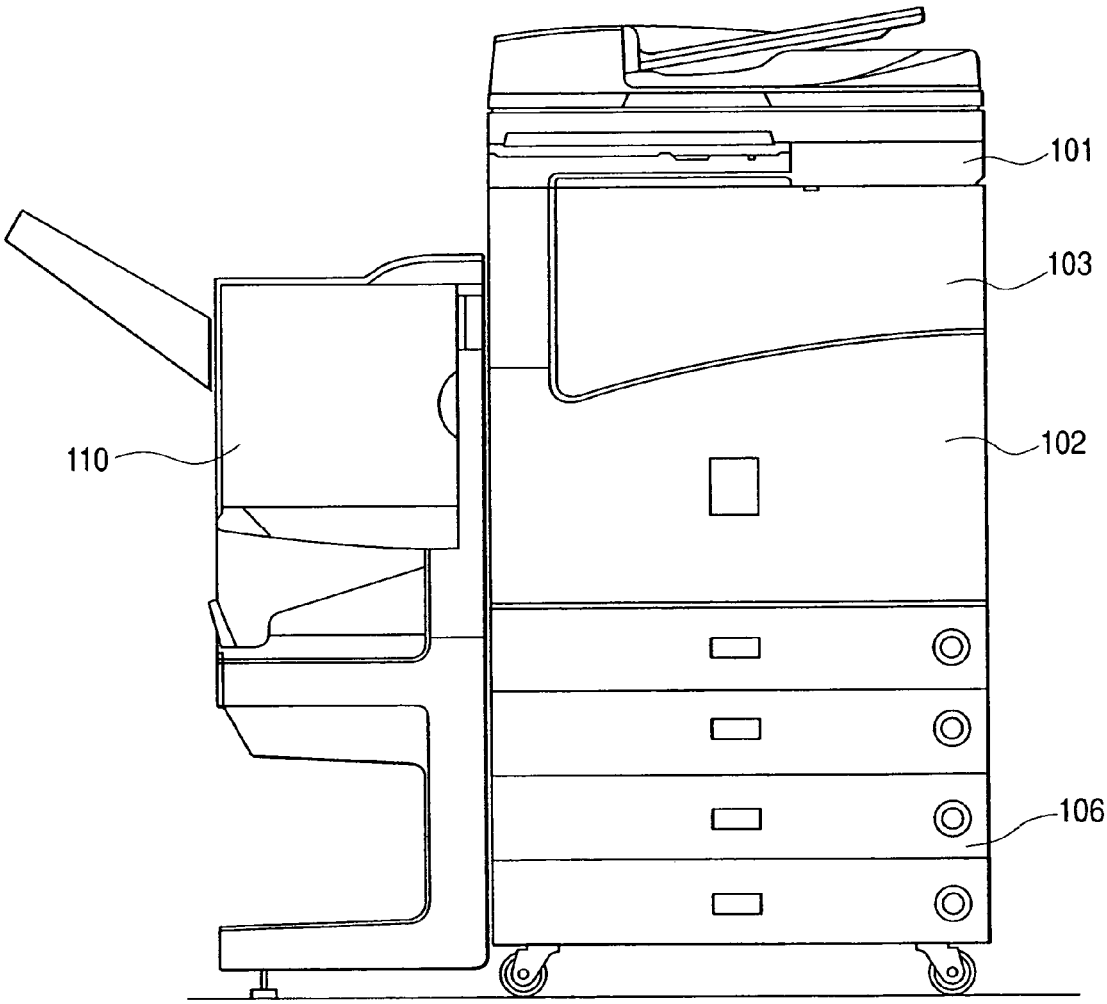
FIG. 20 PRIOR ART
FIG. 20 is an explanatory view showing connection of a sheet treating apparatus to a side of an apparatus main body.

FIGS. 17A and 17B show sheet treating means of an image forming apparatus according to the sixth embodiment: FIG. 17A is a sectional view of the sheet treating means; and FIG. 17B is an explanatory view taken along the arrow A of FIG. 17A. FIGS. 18A and 18B show an aligning member; FIG. 18A is a view showing a state of the sheet treating means supporting a sheet lower end; and FIG. 18B is an explanatory view showing a state of the sheet treating means feeding a sheet-stack to an in-body transportation path.

According to the embodiment, in place of the rotatable hit reference member 237 of the fourth embodiment, hitting portions 290*a* and 290*b* are provided as hamate hit reference members are provided in lower ends of front and rear aligning plates 232*a* and 232*b* for aligning sheets in a cross direction.

As shown in FIG. 17A, sheets P transported into an intermediate treatment tray 231 are hit against the hitting portions 290*a* and 290*b* located in the lower ends of the intermediate treatment tray 231, and stacked. The hitting portions 290*a* and 290*b* are respectively provided in the lower ends of the front and rear aligning plates 232*a* and 232*b*. Accordingly, when a sheet is transported into the intermediate treatment tray 231, a space between the front and rear aligning plates 232*a* and 232*b* is set larger than the width of the sheet to be transported, and the plates 232*a* and 232*b* are set in standby positions for supporting a lower end of the transported sheet on the hitting portions 290*a* and 290*b*.

As shown in FIG. 17A, ends of the hitting portions 290*a* and 290*b* are formed upright so as to prevent the hit sheet P from deviating and falling-off, and the hitting portions 290*a* and 290*b* are formed in a shape of a horseshoe in section.

When a sheet-stack is fed to a nip area of the delivery roller, as shown in FIG. 18B, the front and rear aligning plates 232*a* and 232*b* are moved in directions away from each other, and the hitting portions 290*a* and 290*b* are retreated from an area of an in-body transportation path 272. Thus, the sheet-stack is dropped with the aid of gravity to enter a nip area of a delivery roller pair 221. Then, the delivery roller pair 221 is rotated to deliver the sheet-stack to the delivery space portion 3.

According to the embodiment, by forming the hitting portions 290*a* and 290*b* in the lower ends of the aligning plates 232*a* and 232*b*, a low-cost constitution can be achieved without providing any new driving means such as a solenoid for driving the hit reference members.

What is claimed is:

1. A sheet treating apparatus to be disposed directly above an image forming portion of an image forming apparatus, said sheet treating apparatus comprising:

a sheet post-treating portion which executes a post-treatment operation, while holding a sheet in a substantially vertical state above the image forming portion;

a delivery portion provided substantially over and above the sheet post-treating portion which upwardly delivers the sheet executed by said sheet post-treating portion; and a delivery tray provided above the sheet post-treating portion, which receives the sheet substantially vertically as delivered by said delivery portion.

2. A sheet treating apparatus according to claim 1, wherein said sheet post-treating portion includes a treatment tray which holds a sheet in the substantially vertical state, and an abutting reference member against which a lower end of the sheet contained in said treatment tray is abutted.

3. A sheet treating apparatus according to claim 1, comprising a plurality of delivery trays arranged in a transverse direction.

4. A sheet treating apparatus according to claim 3, wherein said plurality of delivery trays are movable in the transverse direction.

* * * * *

UNITED STATES PATENT AND TRADEMARK OFFICE

CERTIFICATE OF CORRECTION

PATENT NO. : 7,331,573 B2
APPLICATION NO. : 11/352241
DATED : February 19, 2008
INVENTOR(S) : Mizuta et al.

It is certified that error appears in the above-identified patent and that said Letters Patent is hereby corrected as shown below:

COLUMN 2:
Line 33, “imager” should read --image--.

COLUMN 3:
Line 13, “freeing” should read --feeding--.
Line 64, “image-reading” should read --image reading--.

COLUMN 4:
Line 24, “selected.).” should read --selected).--.

COLUMN 6:
Line 37, “stable” should read --staple--.

COLUMN 8:
Line 62, “hit reference 5*a*” should read --hit reference member 5*a*--.

COLUMN 10:
Line 57, “above” should be deleted.
Line 58, “vertically,” should read --vertically above,--.

COLUMN 11:
Line 14, “tray, 231” should read --tray 231--.
Line 64, “tion i.e.” should read --tion i.e.,--.

COLUMN 12:
Line 24, “units” should read --unit--.

UNITED STATES PATENT AND TRADEMARK OFFICE

CERTIFICATE OF CORRECTION

PATENT NO. : 7,331,573 B2
APPLICATION NO. : 11/352241
DATED : February 19, 2008
INVENTOR(S) : Mizuta et al.

It is certified that error appears in the above-identified patent and that said Letters Patent is hereby corrected as shown below:

COLUMN 14:

Line 25, "are" should be deleted.

Signed and Sealed this

Second Day of September, 2008

JON W. DUDAS
*Director of the United States Patent and Trademark Office*